US010967534B2

(12) United States Patent
Talken et al.

(10) Patent No.: US 10,967,534 B2
(45) Date of Patent: Apr. 6, 2021

(54) SCRAP SCRAPER

(71) Applicant: Geo. M. Martin Company, Emeryville, CA (US)

(72) Inventors: Daniel J. Talken, Lafayette, CA (US); David R. Carlberg, Oakland, CA (US)

(73) Assignee: Geo. M. Martin Company, Emeryville, CA (US)

( * ) Notice: Subject to any disclaimer, the term of this patent is extended or adjusted under 35 U.S.C. 154(b) by 1007 days.

(21) Appl. No.: 13/896,545

(22) Filed: May 17, 2013

(65) Prior Publication Data

US 2013/0319195 A1 Dec. 5, 2013

Related U.S. Application Data

(60) Provisional application No. 61/655,296, filed on Jun. 4, 2012.

(51) Int. Cl.

| | |
|---|---|
| ***B26D 7/18*** | (2006.01) |
| *B31B 50/22* | (2017.01) |
| *B31B 50/14* | (2017.01) |

(52) U.S. Cl.

CPC ..... *B26D 7/18* (2013.01); *B31B 50/146* (2017.08); *B31B 50/22* (2017.08); *Y10T 83/0467* (2015.04); *Y10T 83/2083* (2015.04)

(58) Field of Classification Search

CPC ..... B65G 45/12–16

See application file for complete search history.

(56) References Cited

U.S. PATENT DOCUMENTS

| | | | |
|---|---|---|---|
| 2,101,328 | A | 12/1937 | Broadmeyer |
| 2,212,300 | A | 8/1940 | Whorter |
| 2,843,377 | A | 7/1958 | Eckersley |

(Continued)

FOREIGN PATENT DOCUMENTS

| | | |
|---|---|---|
| EP | 0493229 | 7/1992 |
| EP | 2149436 | 2/2010 |

(Continued)

OTHER PUBLICATIONS

Office Action dated Dec. 20, 2013, U.S. Appl. No. 13/408,916.

(Continued)

*Primary Examiner* — Brian D Keller

(74) *Attorney, Agent, or Firm* — Vierra Magen Marcus LLP

(57) ABSTRACT

Scrap Scraper technology is an improved Scrap Separation means for separating Loose Scrap from Boxes within a Layboy with minimal, if any, increase in possible Flap bending. A Distinct Intersection Of Action avoids problems inherent in other prior art. A shallow Scraper Funnel while maintaining a steep Scraper Angle Of Action allows effective Scrap Scraping while avoiding Flap bending. The Flexible Scraper results in Active Scrap Ejection of the Loose Scrap from the upper side of the Box down below the Board Line. Means providing the Scrap Scraper Variable Board Line Penetration and Variable Scraper Stiffness allow effective Scrap removal over a wide range of Boxes. Positioning the Scrap Scraper over a Scrap Exit Opening allows the removed Scrap to exit the Board Line area. Scrap shingling provides for subsequent boxes to push down scrap from a current box.

21 Claims, 36 Drawing Sheets

(56) References Cited

U.S. PATENT DOCUMENTS

| | | | | | |
|---|---|---|---|---|---|
| 3,000,631 | A | | 9/1961 | Hain | |
| 3,353,458 | A | * | 11/1967 | Johnson | B26D 7/1818 493/373 |
| 3,380,328 | A | | 4/1968 | Martin | |
| 3,395,598 | A | | 8/1968 | Martin | |
| 3,565,423 | A | | 2/1971 | Kluth | |
| 3,589,599 | A | | 6/1971 | Brandt | |
| 3,612,270 | A | | 10/1971 | Benbenek | |
| 3,626,561 | A | | 12/1971 | Luce | |
| 3,650,376 | A | | 3/1972 | Burgis | |
| 3,650,446 | A | | 3/1972 | Samluk | |
| 3,693,850 | A | | 9/1972 | Feild | |
| 3,761,074 | A | | 9/1973 | Benbenek | |
| 3,807,610 | A | * | 4/1974 | Mueller, Jr. | B26D 7/18 225/94 |
| 3,827,322 | A | | 8/1974 | Saunders | |
| 3,860,232 | A | | 1/1975 | Martin | |
| 3,880,420 | A | | 4/1975 | Martin | |
| 3,889,863 | A | | 6/1975 | Deslauriers | |
| 3,912,258 | A | | 10/1975 | Martin | |
| 3,942,786 | A | | 3/1976 | Lauren | |
| 3,992,001 | A | | 11/1976 | Martin | |
| 4,099,712 | A | | 7/1978 | Martin | |
| 4,106,767 | A | | 8/1978 | Schirrmeister | |
| 4,111,411 | A | | 9/1978 | Graves | |
| 4,177,536 | A | | 12/1979 | Powers | |
| 4,229,827 | A | | 10/1980 | Bowman | |
| 4,238,870 | A | | 12/1980 | Fahlen | |
| 4,269,401 | A | | 5/1981 | Sargis | |
| 4,305,716 | A | | 12/1981 | Nickum | |
| 4,306,476 | A | | 12/1981 | Saunders | |
| 4,319,442 | A | | 3/1982 | Frye | |
| 4,369,682 | A | | 1/1983 | Bunnell | |
| 4,380,332 | A | | 4/1983 | Davis | |
| 4,433,774 | A | | 2/1984 | Lopes | |
| 4,467,948 | A | | 8/1984 | Deslauriers | |
| 4,474,565 | A | | 10/1984 | Watson | |
| 4,499,802 | A | | 2/1985 | Simpson | |
| 4,589,650 | A | | 5/1986 | Mihoshi | |
| 4,740,193 | A | | 4/1988 | Frost | |
| 4,846,030 | A | | 7/1989 | McMahon | |
| 4,852,712 | A | | 8/1989 | Best | |
| 4,900,297 | A | | 2/1990 | Frost | |
| 4,955,102 | A | | 9/1990 | Cousins | |
| 5,026,249 | A | | 6/1991 | Shill | |
| 5,039,083 | A | | 8/1991 | Senn | |
| 5,111,725 | A | | 5/1992 | Simpson | |
| 5,152,522 | A | | 10/1992 | Yamashita | |
| 5,365,815 | A | | 11/1994 | Pfaff, Jr. | |
| 5,697,878 | A | | 12/1997 | Elkis | |
| 5,701,789 | A | | 12/1997 | Okonski | |
| 5,931,455 | A | | 8/1999 | Okui | |
| 6,332,488 | B1 | | 12/2001 | Walsh | |
| 6,412,379 | B1 | * | 7/2002 | Turusaki | B26D 7/18 83/155.1 |
| 6,427,097 | B1 | | 7/2002 | Martin | |
| 6,619,653 | B2 | | 9/2003 | Dobrindt | |
| 6,669,191 | B2 | | 12/2003 | Lee | |
| 6,851,539 | B2 | | 2/2005 | Flippo | |
| 7,044,040 | B1 | | 5/2006 | Smith | |
| 7,111,534 | B1 | * | 9/2006 | Simpson | B26D 7/1818 83/117 |
| 2004/0182830 | A1 | | 9/2004 | Hesterman | |
| 2012/0222937 | A1 | | 9/2012 | Talken | |

FOREIGN PATENT DOCUMENTS

| | | | | | |
|---|---|---|---|---|---|
| EP | 2495098 | | * | 5/2012 | B26D 7/18 |
| EP | 2495098 | | | 9/2012 | |
| EP | 2495098 | A1 | * | 9/2012 | B26D 7/18 |

OTHER PUBLICATIONS

Response to Office Action dated Mar. 19, 2014, U.S. Appl. No. 13/408,916.

European Search Report dated Jul. 13, 2012, European Patent Application No. 12157927.0.

Response to European Search Report dated Jun. 11, 2014, European Patent Application No. 13169261.8.

European Office Action dated Jul. 14, 2014, European Patent Application No. 13169261.8.

Office Action dated Jul. 18, 2014, U.S. Appl. No. 13/408,916.

Response to Office Action dated Sep. 29, 2014, U.S. Appl. No. 13/408,916.

Response to European Office Action dated Nov. 19, 2014, European Patent Application No. 13169261.8.

European Search Report dated Sep. 25, 2013, Europe Patent Application No. 13169261.8.

Notice of Allowance dated Jan. 9, 2015, U.S. Appl. No. 13/408,916.

* cited by examiner

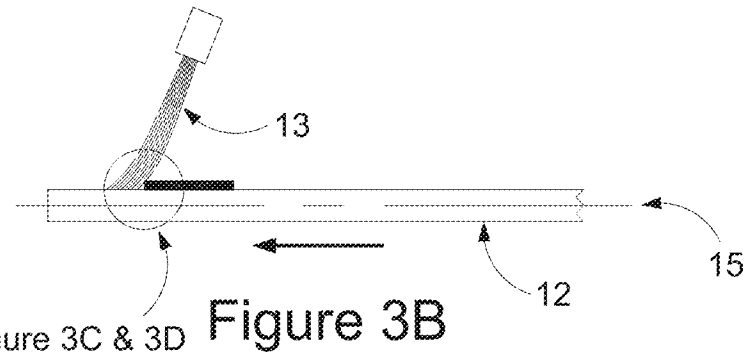
Figure 3A
Figure 3B
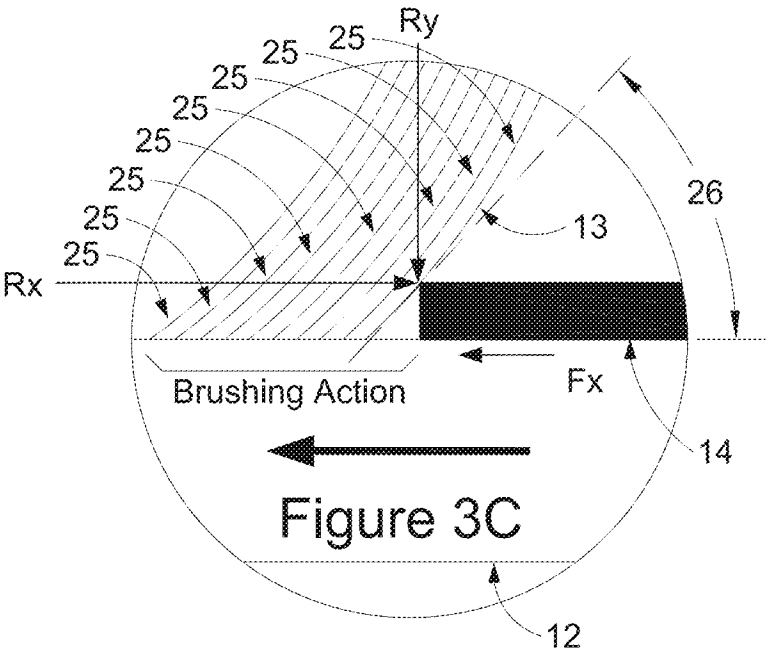
Figure 3C
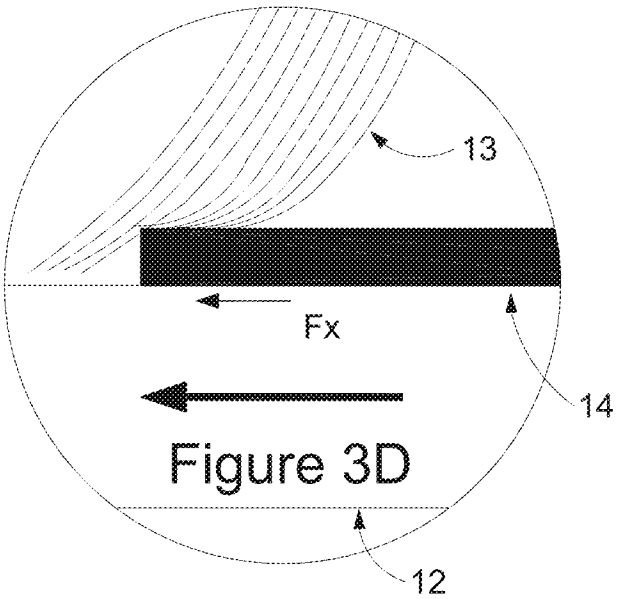
Figure 3D 12
14
20

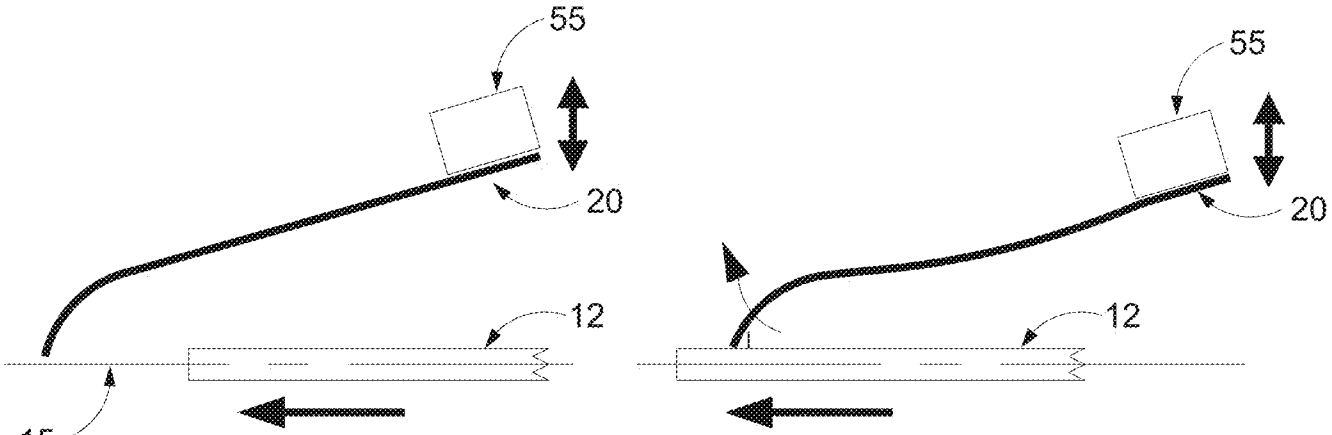
Figure 14A
Figure 14B
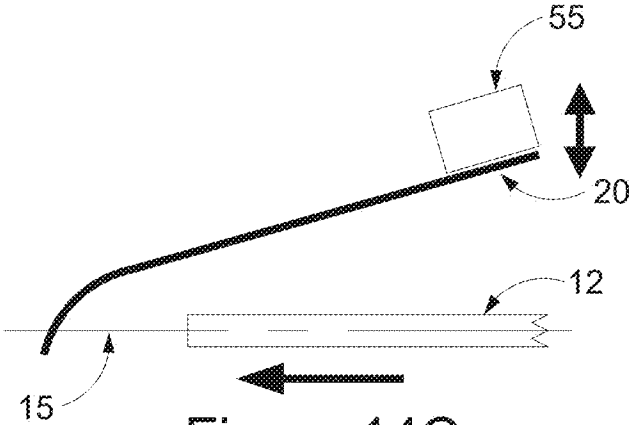
Figure 14C
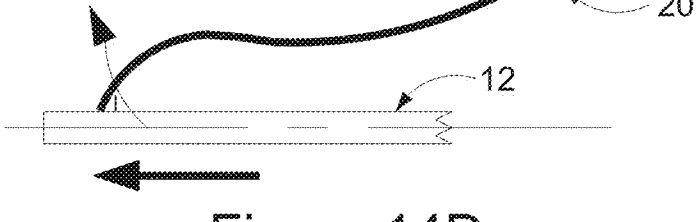
Figure 14D

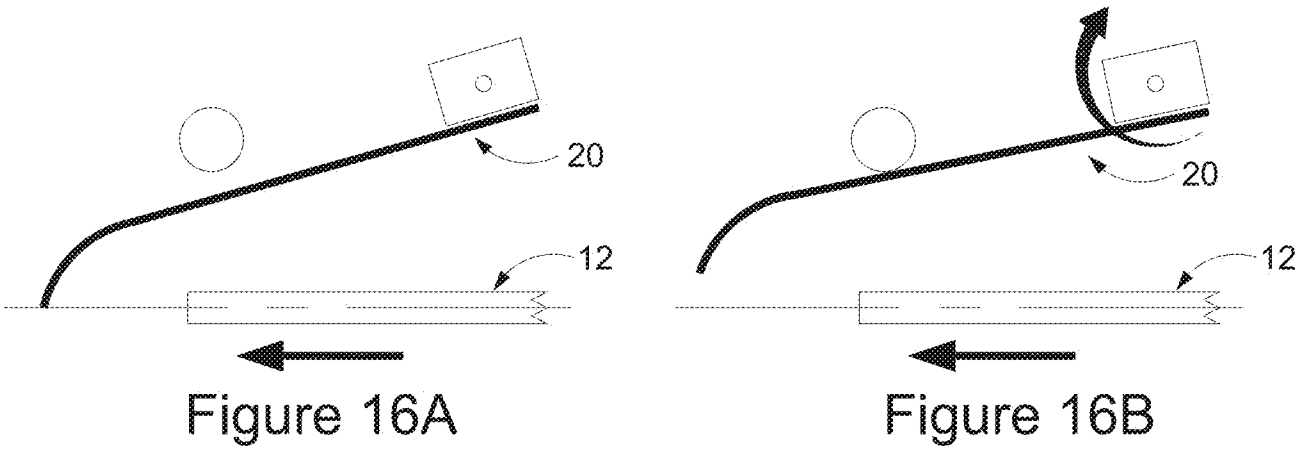
Figure 16A
Figure 16B
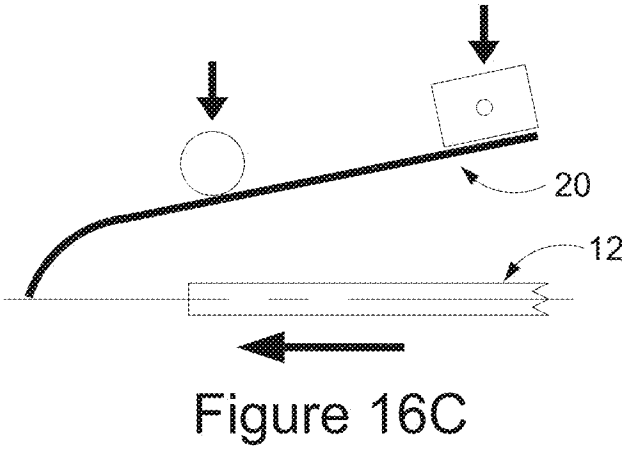
Figure 16C 14
202
16
32
31
17
30
14
14
20
200
33

14
202
16
32
14
17
14
14
20
31
30
200
33

14
202
16
32
17
14
14
14
20
31
200
33

SCRAP SCRAPER

This application claims the benefit of U.S. Provisional Application No. 61/655,296, "Scrap Scraper," filed on Jun. 4, 2012, incorporated herein by reference in its entirety.

BACKGROUND

Manufacturers of corrugated paper products, known as Box Makers, produce both foldable boxes which have been folded and glued at the factory and die cut flat sheets which may be used either in their flat state or folded into a desired shape. These will be referred to as Folded Boxes and Flat Boxes respectively. The term Boxes alone can refer to both Folded and Flat Boxes.

Both the Folded Boxes and the Flat Boxes are produced by Converting machinery which processes the Corrugated Sheet Stock produced by the machinery known as a Corrugator. The Corrugated Sheet Stock is corrugated material cut to a specific size with optional scoring. Scoring is the intentional crushing of the corrugated flutes in order to allow folding of the corrugated material. However, the Corrugated Sheet Stock has not been cut or notched to the detail typically required to produce the final Folded Boxes or the Flat Boxes.

For the purposes of this document, the term Press will refer to the machinery that feeds, prints and cuts the Corrugated Sheet Stock to produce the final Boxes.

Often customized printing is required on Boxes which may be done by 1) using a preprinted material integrated into the Corrugated Sheet Stock on the Corrugator, 2) using flexographic printing during the Converting process or 3) applying ink or labels post Converting through various techniques.

During the Converting process the Corrugated Sheet Stock is transformed into a Box by performing additional cutting and optionally adding scoring and printing. There are multiple possible purposes for the additional cutting of the Corrugated Sheet Stock. As the Corrugated Sheet Stock is transported through the machinery during the Converting process, the Corrugated Sheet Stock and Box travel along a path which is known as the Board Line. Since the corrugated material has thickness and can move vertically up and down a finite amount during transportation the Board Line is a side view of the nominal plane about which the Corrugated Sheet Stock and Box travel. Many of these cutting operations will result in pieces of the original Corrugated Sheet Stock being separated from the final Box. These pieces are in general referred to as Scrap.

In order to achieve the proper print registration, the Corrugated Sheet Stock may be oversized slightly so that some or the entire perimeter is trimmed during the Converting process. This results in what is being defined as Edge Trim Scrap. The Corrugated Sheet Stock is moving in a flow direction during the Converting process and thus Leading Edge Trim Scrap is the Scrap along the entire front edge of the Corrugated Sheet Stock, first to be processed by the Converting machinery. Trailing Edge Trim Scrap is the Scrap along the entire back edge of the Corrugated Sheet Stock, last to be processed. Side Edge Trim Scrap is produced on both sides of the Corrugated Sheet Stock. Slot Scrap is a common relatively long but narrow type of Scrap which when removed allows boxes to be folded properly. All other Scrap will be referred to as Internal Scrap and can come in many sizes and shapes.

If the Scrap is cut completely free from the box and the Ejecting Rubber completely dislodges the Scrap from the box, the Scrap is referred to as Loose Scrap. Ideally the Loose Scrap will be ejected below the Board Line, but in reality Loose Scrap often ends up above the Board Line and is much more difficult to separate from the Boxes. If Internal Scrap is cut completely free from the Box but the Ejecting Rubber fails to dislodge the Scrap from the Box, the Scrap is referred to as Trapped Scrap. If the Scrap is not cut completely free from the box and the Ejecting Rubber fails to tear the Scrap from the box, the Scrap is often attached by a minimal amount of paper hanging onto the box by a thread and is referred to as a Hanging Chad. The amount of residual paper connecting the Hanging Chad to the box determines the Hanging Chad Strength which is defined as the pulling force required to tear the Hanging Chad from the Box. There may also be other types of Scrap.

As the Boxes are produced there are a variety of methods to form Stacks of the Boxes which in turn are sold to other companies which will be referred to as the Box Customer. There are a multitude of applications for these Boxes and there are many reasons why it is undesirable for the Scrap to be included in shipment to the Box Customer. Erecting of the box is the process of taking the box and manipulating it by folding, bending, interlocking, stapling, taping, etc. in order for the Box to be ready for its final usage. For Box Customers that manually erect their Boxes, the inclusion of Scrap is undesirable because of the additional mess created. For Box Customers that use automatic machinery to erect their Boxes, the Scrap can lead to jams in their machinery causing undesirable downtime and lower production. For Box Customers that use the box for food, such as a pizza box, having Scrap included in the final erected box is clearly undesirable.

In the conversion of the Corrugated Sheet Stock into Boxes the material is fed through machinery. The Leading Edge for both Corrugated Sheet Stock and Boxes refers to the first edge of travel across the machine whereas the Trailing Edge refers to the last edge of travel across the machine. The Corrugated Sheet Stock may be cut completely in the cross-machine direction in one or more locations to create two or more Boxes in the through-machine direction. These are referred to as Ups. The Corrugated Sheet Stock may be cut completely in the through-machine direction in one or more locations to create two or more Boxes in the cross-machine direction. These are referred to as Outs.

There are multiple methods by which the cutting of the Corrugated Sheet Stock may be accomplished during the Converting process. One example method for cutting Corrugated Sheet Stock is known as Rotary Die Cutting. A typical configuration of a Rotary Die Cutter, known as Rule And Rubber, uses of a pair of cylinders where the lower cylinder, known as the Anvil, is covered in a firm but rubber like material and the top cylinder is mounted with a Die Board. The Die Board is normally a curved plywood base in which embedded are a customized set of steel Rules, which protrude from the plywood base and when rotated with the Anvil will cut and score the Corrugated Sheet Stock into the final desired Box. The actual cutting of the Box occurs where the tangent of the Die Board meets the tangent of the Anvil. Since there is a finite distance over which cutting occurs, the region of cutting and Die Board control is referred to as the Die Board Control Zone. Ejecting Rubber is located on the plywood base of the Die Board between the Rules in order to eject the Scrap as the Boxes emerge from the nip point of the Die Board and the Anvil. The path of the box between the Die Board and the Anvil is theoretically along the Board Line. However, in reality the box may vary from the Board Line as it exits the Rotary Die Cutter, due to warp of the Corrugated Sheet Stock and the potential sticking or over-ejecting by the Die Board. The transportation speed of the Box, as determined by the effective linear speed at the nip of the Die Board and Anvil, is known as Line Speed. Also relevant would be the similar process of steel-on-steel Rotary Die Cutting. The Rotary Die Cutting process is relevant since there is not an integral method in the process for positive separation of the Scrap from the Box.

A Layboy is defined as the machine with the purpose of transporting corrugated Boxes which may include Scrap from the Press to downstream material handling equipment. Within a Layboy are effective transporting surfaces driven at a linear speed which can be referred to as Layboy Speed. A Layboy typically includes one or more Scrap Separation Means for improved Scrap Separation. The Scrap Separation Means include any one or a combination of apparatus which are intended to improve the effectiveness of Scrap removal.

A concept known as Layboy Over Speed is where the Layboy Speed is greater than the Line Speed. Layboy Over Speed is the ratio of Layboy Speed minus Line Speed and then divided by Line Speed. This concept is primarily intended to accelerate each subsequent Up such that there is a gap, referred to as Up Gap Length, between each of the Ups as the Boxes exit the Layboy which helps facilitate the common technique known as Shingling of the Boxes. Shingling requires the lead Box to move down enough below the Board Line and then slow down such the subsequent Box overlaps the lead Box. The subsequent Box then also moves down and the process continues. The Up Gap Time can be a relative complicated function of the differential between Layboy Speed and Line Speed, length of each Up, point of Layboy control relative to Die Board Control Zone. A good approximation to calculate the Up Gap Length is achieved by multiplying the Layboy Over Speed times the length of the Up. The time it takes for the Up Gap Length to pass a fixed point in the Layboy, known as Up Gap Time is based on the standard velocity, time and length relationship where velocity is Layboy Speed and length is the Up Gap Length.

A Rotary Die Cutter has an effective Die Board Circumference which is essentially the circumference of the Die Board. Common Die Board Circumferences are 37 inches, 50 inches and 66 inches but other sizes exist. The difference in the length of the Die Board Circumference minus the length of the Corrugated Sheet Stock is referred to as Sheet Gap Length. This is the length from the Trailing Edge of a Corrugated Sheet Stock to the Leading Edge of the following Corrugated Sheet Stock. The time it takes for the Sheet Gap Length to pass a fixed point in the Layboy, known as Sheet Gap Time is based on the standard velocity, time and length relationship where velocity is Line Speed and length is the Sheet Gap Length. The Sheet Gap Time is how long Loose Scrap on the upper side of the Box has to move from the upper side of the Box to below the Board Line within the Sheet Gap Length.

A Box that has been Die Cut commonly has cutting and scoring such that when folded a corner is naturally formed. When in flat form, the corner is a peninsula of corrugated material at the corner of the Box, and referred to as a Flap. Since the Flaps are partially cut from the main body of the Box, they are less rigid, require better support during transportation and are more easily bent backwards. An improvement in Scrap Separation at the expense of causing Flaps to be more frequently bent backward would have limited if any value.

The foldable cube type box is typically produced by a system referred to in the industry as a Flexo Folder Gluer. This may include Rotary Die Cutting or Slotting-Scoring. The Flat Box is typically produced by either a Rotary Die Cutter (which includes Rotary Die Cutting) or by a Flat Bed Die Cutter.

The Box Makers typically have many customers and a wide variety of different style of Boxes which need to be produced. They need to set up and run many different orders during a given production period. The Box Maker is highly motivated to reduce the time used for setting up a new order. This is known as Order Setup Time.

The Box Maker often will setup and run an order initially and then need to repeat running of the order multiple times periodically in the future. There is value to the Box Maker in providing the ability to setup faster for a repeat order by returning to the configuration specified by the operator the last time the order ran. This is known is Repeat Order Setup.

The quality of the box surface and print quality is an important factor to the Box Maker and the Box Customer. Any process that damages the actual surface of the corrugated material or reduces the quality of the printing by smearing or marking can result in un-sellable Boxes or Boxes of lower value. Many Layboy applications involve sandwiching the box as it is being transported. Excessive pressure on the box can create permanent crushing of the Box flutes which is known as False Scoring. Exposing a printed surface of the Box to a transporting surface with a significant combination of relative velocity and pressure can damage the print which is known as Print Damage.

In prior art, the usage of a Brush extending laterally across the width of a Layboy has been used to improve Scrap Separation. A Brush is defined as a plurality of flexible Brush Bristles bound together by a Brush Backing. The Brush Bristles typically have a round cross section but other cross sections are possible. The Brush Bristle Center Line is defined as the path through the Brush Bristle's longitudinal center of mass. The Brush Bristle Center Line is typically straight when the Brush Bristles are new and not in contact with the Boxes, however, the Brush Bristle Center Line can be curved due to engaging the Boxes or from a permanent bending caused by usage, or from both. As a result, the Brush Bristle Angle is the tangent to the Brush Bristle Center Line relative to the Board Line at a given point along the Brush Bristle. The Base Brush Bristle Angle is at the point where the Brush Bristle exits the Brush Backing. The Contact Brush Bristle Angle is at the end of the Brush Bristle where the Brush Bristle makes contact with the Box. The Brush Bristles may be assembled to the Brush Backing such that all the Base Brush Bristle Angles are very similar or they may be assembled such that the Base Brush Bristle Angles vary within the Brush Backing, as found in the typical floor push broom. The Brush Bristles may be straight while some Brushes will have multiple small bends back and forth within each Brush Bristle about the Brush Bristle Center Line. The Brush Bristles with multiple bends are assembled such that the bends are randomly bound to the Brush Backing. The size and proportions of the Brush Bristles are such that the intent is for the plurality of Brush Bristles to act together in the through machine direction in order to create the Brushing Action. A Brush when mounted by its Brush Backing in a Layboy will have a plurality of Brush Bristles laterally across the machine as well as a plurality of Brush Bristles in the through-machine direction.

Additional Scrap Separation apparatus are Compliant Scrap Blocker, an Opposing Phase Shift Beater, a Chad Wall, a Compliant Scrap Blocker-Wedge Roller, and an Edge Trim Chad Stripper, which are described in United States Patent Application Publication 2012/0222937, "Scrubber Layboy."

SUMMARY

The Scrap Scraper technology is an improved Scrap Separation means that is applicable in multiple Layboy machinery configurations. The technology is primarily effective in separating Loose Scrap which is on top of the Boxes and needs to be separated and moved below the Board Line and the following Boxes. This type of Scrap is challenging not only because the separation at production speeds is difficult but also due to the short amount of time available to get the removed scrap from above the Box to below the next Box in the gap between the Boxes. The Scrap Scraper technology is also effective on Edge Trim Scrap including Hanging Chads. The Scrap Separation is accomplished with minimal, if any, increase in possible Flap bending. This technology herein is applicable to both the production of Folded Boxes and Flat Boxes.

The concept of Scraping Action versus Brushing Action is a substantial improvement in Scrap Separation. In Brushing Action, since there is a plurality of relatively weak Brush Bristles both laterally and in the through-machine direction there is no Distinct Intersection Of Action, whereas Scraping Action has a Distinct Intersection Of Action. The preferred embodiment of the Scrap Scraper solves the fundamental problem of providing a shallow Scraper Funnel in order to minimize Flap bending while maintaining a steep Scraper Angle Of Action to assure the Distinct Intersection Of Action required for maximum Scrap Separation by avoiding the Scrap Resistance-Friction Phenomenon. Combining the Scraping Action with the Flexible Scraper configuration results in the desirable ability to actively eject any accumulated Loose Scrap from the upper side of the Box down below the Board Line in the gaps between the sequential boxes. Means providing the Scrap Scraper with Variable Board Line Penetration and Variable Scraper Stiffness allow effective Scrap removal over a wide range of Boxes. Positioning the Scrap Scraper over a Scrap Exit Opening allows the removed Scrap to exit the Board Line area. There are multiple Layboy transportation configurations which will allow the advantage of the Scrap Scraper technology.

One embodiment includes an apparatus for separating scrap from corrugated boxes, comprising: a scrap scraper positioned laterally above a path for moving corrugated boxes potentially having scrap created by rotary die cutting, the scrap scraper positioned above an opening created by surfaces that support and transport the corrugated boxes, the scrap scraper contacts the moving corrugated boxes with a contacting edge of the scrap scraper and performs a scraping action against an upper surface of the boxes, an upstream surface of the scrap scraper diverts forward motion of the scrap, the contacting edge of the scrap scraper and the upstream surface are part of a single element in a through machine direction. In some example implementations, the scrap scraper contacts the moving corrugated boxes with the contacting edge of the scrap scraper and performs the scraping action against the upper surface of the boxes in a production environment at modern production rates.

One embodiment includes an apparatus for separating scrap from corrugated boxes, comprising: a scrap scraper positioned laterally above a path for moving corrugated boxes potentially having scrap created by rotary die cutting; and one or more surfaces that support and transport the corrugated boxes, the one or more support surfaces include a lateral opening located below the scrap scraper, the scrap scraper contacts the moving corrugated boxes and performs a scraping action, the apparatus provides a flexing force on the moving corrugated boxes.

One embodiment includes an apparatus for separating scrap from corrugated boxes, comprising: scrap scraper positioned laterally above a path for moving corrugated boxes potentially having scrap created by rotary die cutting, the scrap scraper positioned above a opening in one or more surfaces that support and transport the corrugated boxes, the scrap scraper contacts the moving corrugated boxes and performs a scraping action, the scrap scraper comprises a non-linear cross-sectioned panel having a box contact end and a funnel region distal to the box contact end, the panel forms an scraper angle of action with the moving corrugated boxes at the contact end, a tangent of the panel at the funnel region forms a scraper funnel angle with the moving corrugated boxes, the scraper angle of action is greater than the scraper funnel angle.

One embodiment include a method of separating scrap from corrugated boxes, comprising: scraping the tops of moving corrugated boxes potentially having scrap created by rotary die cutting using a scrap scraper positioned laterally above a path for moving the corrugated boxes and above an opening created by surfaces that support and transport the corrugated boxes, the scrap scraper contacting the moving corrugated boxes with a contacting edge of the scrap scraper and performing a scraping action against an upper surface of the boxes, the scrap scraper diverts forward motion of the scrap using an upstream surface of the scrap scraper, the contacting edge of the scrap scraper and the upstream surface are part of a single element in a through machine direction.

One embodiment includes an apparatus for separating scrap from corrugated boxes, comprising: a scrap scraper positioned laterally above a path for moving corrugated boxes potentially having scrap created by rotary die cutting, the scrap scraper positioned above an opening created by surfaces that support and transport the corrugated boxes, the scrap scraper contacts the moving corrugated boxes and performs a scraping action with a distinct intersection of action between an upper surface of the boxes and a contacting edge of the scrap scraper.

One embodiment includes as apparatus for separating scrap from corrugated boxes, comprising: a scrap scraper positioned laterally above a path for moving corrugated boxes potentially having scrap created by rotary die cutting, the scrap scraper positioned above an opening created by surfaces that support and transport the corrugated boxes, the scrap scraper contacts the moving corrugated boxes with a contacting edge of the scrap scraper and performs a scraping action against an upper surface of the boxes, an upstream surface of the scrap scraper diverts forward motion of the scrap, the board path leading into the scrap scraper is elevated relative to the board path exiting the scrap scraper.

One embodiment includes a method for separating scrap from corrugated boxes, comprising: receiving a subsequent box at a scrap scraper along an input path; deflecting the subsequent box at the scrap scraper to an exit path that is below the input path thereby pushing down scrap from a previous box; contacting the subsequent box with a contacting edge of the scrap scraper to perform a scraping action against an upper surface of the subsequent box; and diverting forward motion of the scrap using an upstream surface of the scrap scraper.

DESCRIPTION OF THE DRAWINGS

FIGS. 3A-3D depicts prior art brushes and the Scrap Resistance-Friction Phenomenon.

FIGS. 14A-14D are side views of Variable Board Line Penetration.

FIG. 16A-16C are side views of selectable Support System allowing Variable Scraper Stiffness and Variable Board Line Penetration.

DETAILED DESCRIPTION

For the purposes of this document, the term Conveyor will refer to a mechanical apparatus consisting of an endless moving belt, chain or other material wrapped around two or more pulleys to transport material by means of surface contact between the belt, chain or other material which moves in a linear motion motivated by the rotary motion of one of more of the pulleys. The term Conveyor Belt will be used with the understanding that is also could be endless chain or other material. The cross section of the Conveyor Belt can be of a variety of shapes, typically round, rectangular or V. The cross section defines the Conveyor Belt Width and defines the surface used for material transport. The term Wheel Assembly is a shaft with wheels laterally positioned and rotated such that the surfaces of the wheels transport Boxes while leaving openings between the wheels. The term Roller is a substantially wide cylinder which can be laterally oriented across the machine and rotated such that the surface of the cylinder can transport Boxes.

As defined, a Layboy transports corrugated Boxes which may include Scrap. The transport means in prior art varies, including Conveyors with both narrow and wide Conveyor Belt Widths. Wheel Assemblies, Rollers and Vacuum Conveyor Belts are additional methods by which the Boxes may be transported. Further more, in the through-machine direction lateral openings across the machine can be created by using one or more Conveyors, Wheel Assemblies, Rollers, Fixed Surfaces or Overhead Vacuum in series with spacing such that a lateral opening exist between the upstream Box Lateral Support and the downstream Box Lateral Support. In many Layboy configurations, the use of Sandwich Transportation is implemented. This is defined as a system which incorporates any sort of below and above Board Line transportation means for the Boxes.

The Scrap Scraper technology is integrated in a Layboy which in turn is located between the upstream Press, which produces the Boxes with Scrap, and the downstream processing equipment which typically makes stacks of the Boxes. The Scrap Scraper technology can work in conjunction with multiple combinations of transportation means.

Figure 1:
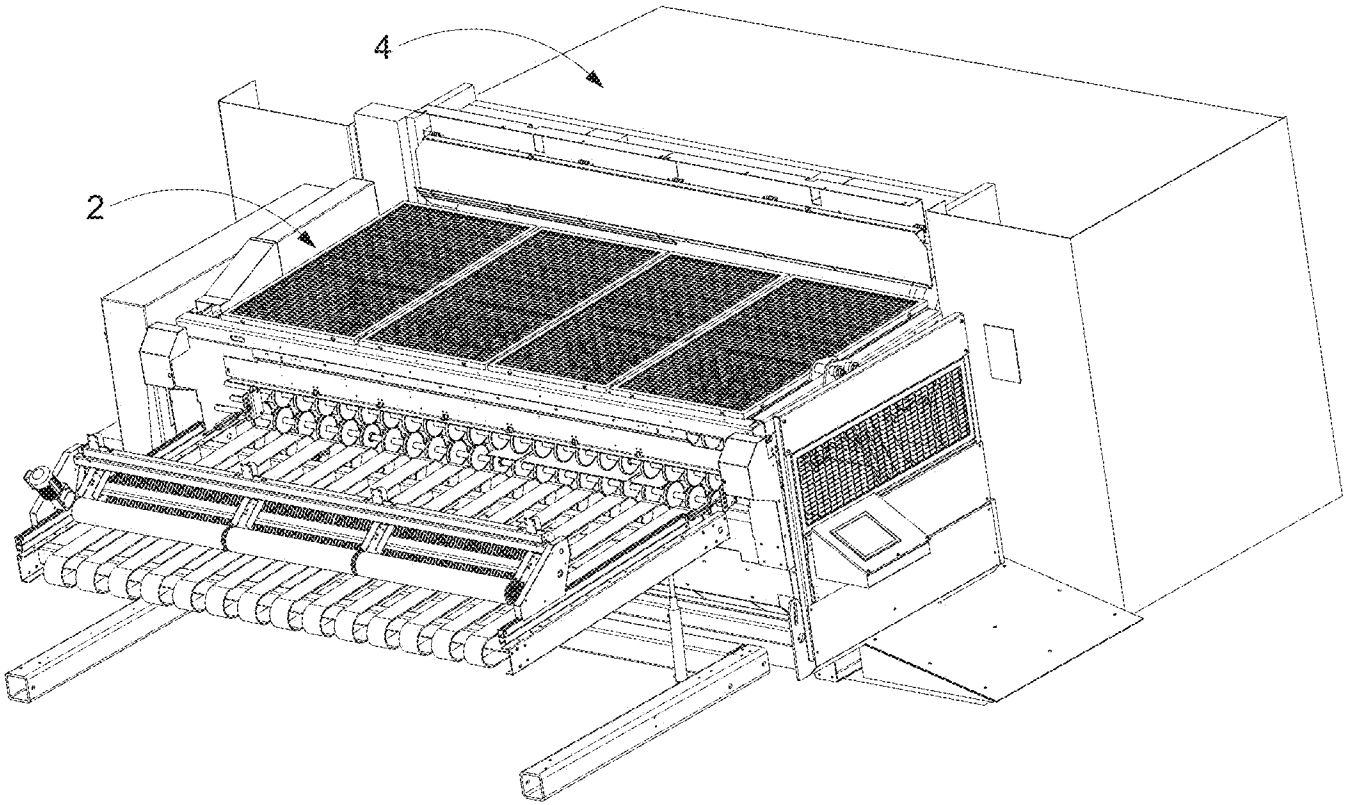
FIG. 1 depicts one embodiment of a Layboy interfacing with a Rotary Die Cutter.
Figure 2:
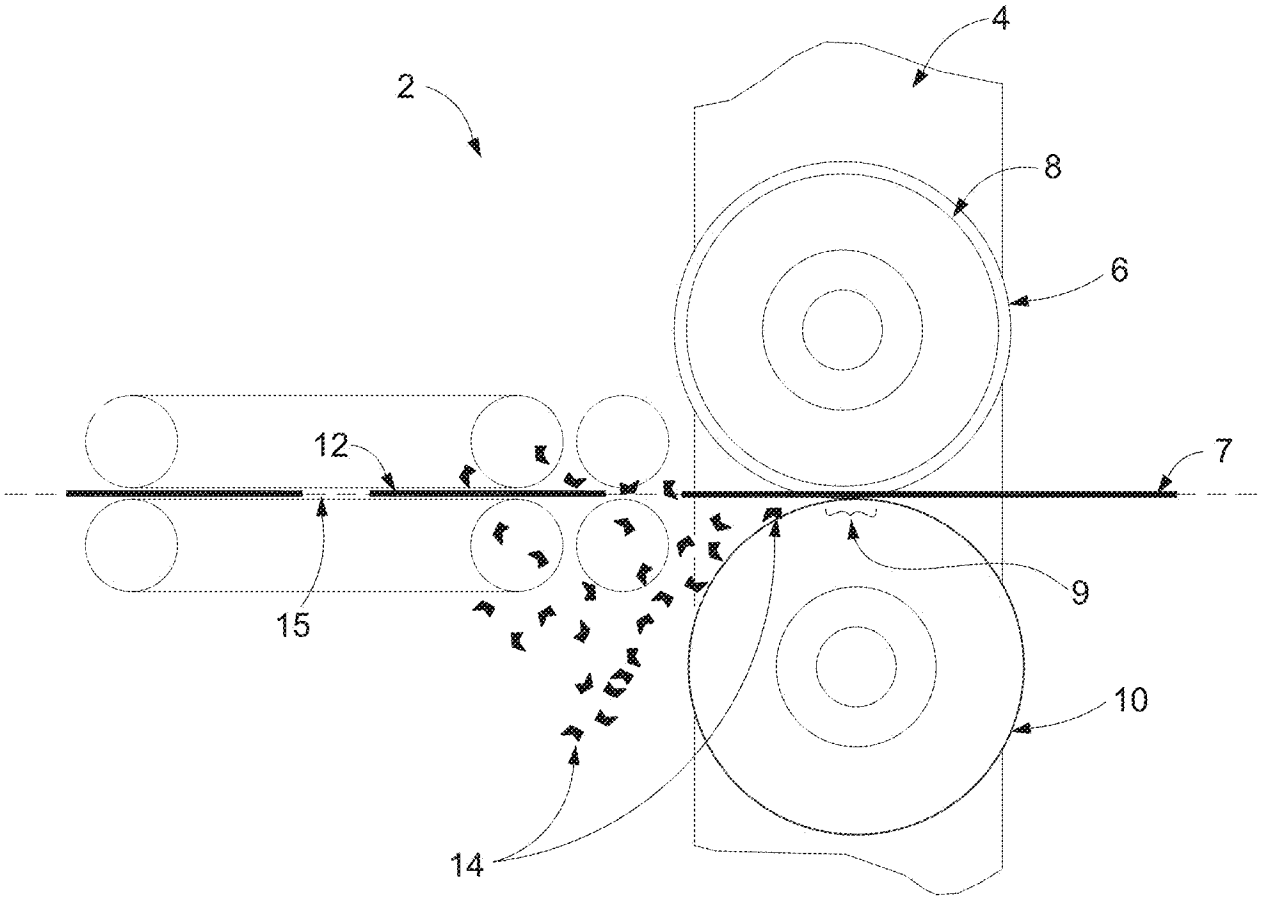
FIG. 2 is a side view of the Rotary Die Cutter shows the Corrugated Sheet Stock, Boxes and the Scrap.

The typical Rotary Die Cutter operation with the Layboy is shown in FIG. 1, which depicts a Layboy 2 adjacent to a Rotary Die Cutter 4. The Layboy 2 and Rotary Die Cutter 4 are also shown in FIG. 2 using a simplified representation. The Die Board 6 is located on the top cylinder 8 and the Anvil 10 is located on the bottom cylinder such that as the Box 12 and Scrap 14 are being created from the Corrugated Sheet Stock 7, the Box 12 theoretically continues on Board Line 15 and ideally the Scrap is ejected below Board Line 15. In practice, for a variety of reasons the Scrap may not all be ejected below Board Line 15.

When Loose Scrap exits the Rotary Die Cutter it has a forward velocity and while being transported by a Sandwich Transportation style Layboy the Loose Scrap is often further propelled forward by the upper transporting surfaces. In order to keep this Loose Scrap from exiting the Layboy, the Loose Scrap needs to be separated from the Box and then moved below the Board Line at which point gravity can take the Scrap away.

The Scrap Separation of Loose Scrap is challenging since the Scrap may either be bouncing or flying above the upper surface of the Boxes or laying flat against the Boxes. The Scrap Resistance-Friction Phenomenon is a problem inherent in the Brushing Action provided by Brushes found in prior art. FIGS. 3A-3D show the concept of Brushing Action. FIG. 3A shows a side view of a typical Brush 13 in its nominal position with an incoming Box 12 and a piece of Loose Scrap 14 on top of a Box 12. In FIG. 3B the Box 12 is under the Brush 13 and the Brush Bristles 25 are flexing with the Scrap 14 now flat against the upper side of the Box 12. The Scrap 14 is just beginning to see the resistance of the first Brush Bristles 25. FIG. 3C is a zoomed-in view of FIG. 3B showing the Brushing Action zone. In order to have any substantial Brushing Action the tip of the Brush Bristles 25 are nominally interfering with the Box 12 such that when the Box 12 experiences the Brushing Action, the end of the Brush Bristles 25 are curved. While the total resistance provided by the Brush 13 is a combination of all the Brush Bristles 25 in the through machine direction, each individual Brush Bristle 25 is much weaker. The first Brush Bristles 25 will provide some resistive force to through-machine direction motion, Rx, but at the same time will provide some downward force onto the Scrap, Ry, creating additional friction between the Box 12 and the Scrap 14. Depending on a multitude of factors, such as coefficient of friction, Brush Bristle 25 properties, moisture of the Boxes 12 and Contact Brush Bristle Angle 26, the friction force, Fx, driving the Scrap 14 can overcome the Brush resistance and the Scrap 14 will slip under the Brush (FIG. 3D) staying above the Board Line and the Boxes. There is no distinct intersection between the Brush Bristles 25 and Box 12.

Figure 4A:
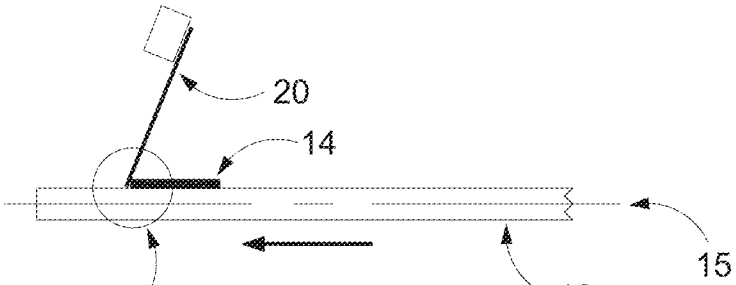
FIGS. 4A-4D are side views of the concept of the Scrap Scraper Distinct Intersection Of Action.
Figure 4B:
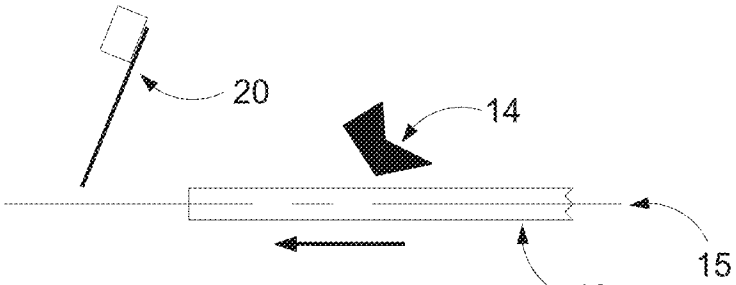
Figure 4C:
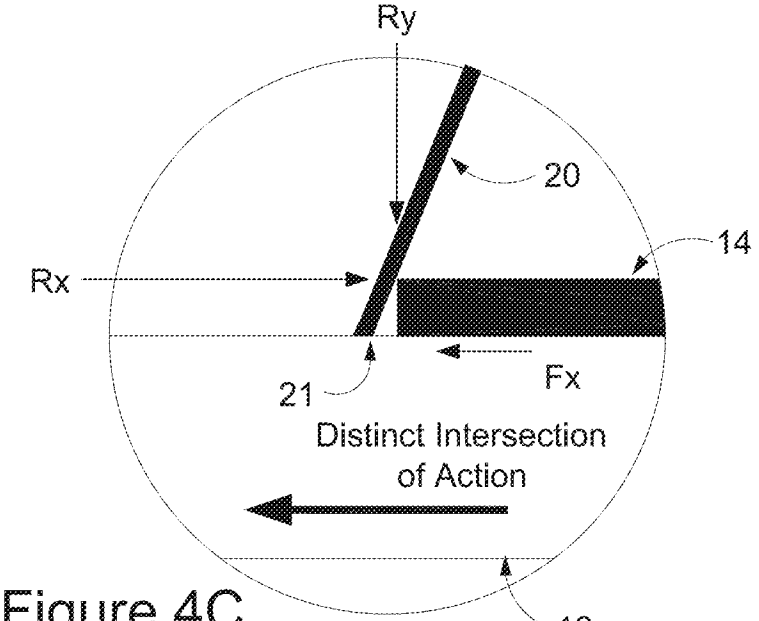
Figure 4D:
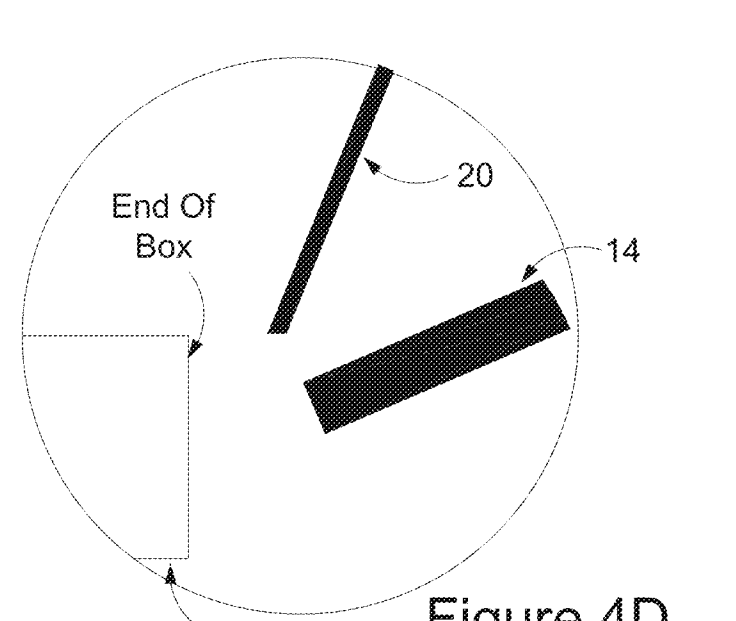

FIGS. 4A-4D show the concept of Scraping Action with a contacting edge 21 of the Scrap Scraper and the Distinct Intersection Of Action. FIG. 4A shows a side view of a Scrap Scraper 20 in its nominal position with an incoming Box 12 and a piece of Loose Scrap 14 on top of Box 12. In FIG. 4B, Box 12 is under the Scrap Scraper 20 with the Scrap 14 now flat against the upper side of Box 12. The Scrap 14 is just beginning to see the resistance of the Scrap Scraper 20. FIG. 4C is a zoomed-in view of FIG. 4B showing the Scraping Action and the Distinct Intersection Of Action, which is defined as follows: The focus of adequate strength is entirely in the region of the contacting edge 21 which is where the upstream surface of the Scrap Scraper 20 and the Box 12 intersect. Brush Bristles get their strength by acting together in the through machine direction, and so have no Distinct Intersection of Action or scraping edge. The Scrap Scraper 20 provides the required resistive force to through-machine direction motion, Rx, without needing to flex downstream which would increase the downward force onto the Scrap, Ry. The result is that the Scrap 14 can no longer move forward, and once the Trailing Edge of the Box 12 has been transported past the Scrap Scraper Edge 21, FIG. 4D, the Scrap 14 is now above a gap between Boxes 12 and able to get below the Board Line 15.

Figure 5A:
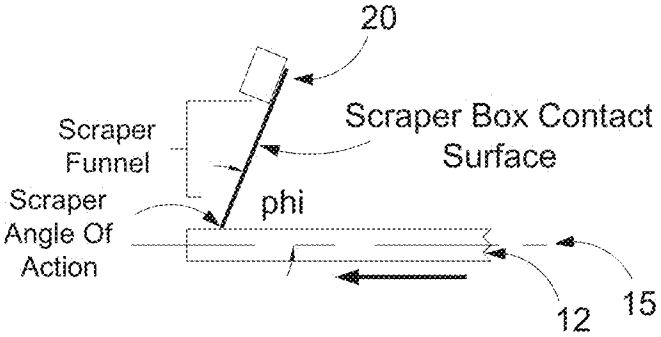
FIGS. 5A-5D are side views of a nominally straight Scrap Scraper, the Scraper Funnel and the Scraper Angle Of Action.
Figure 5B:
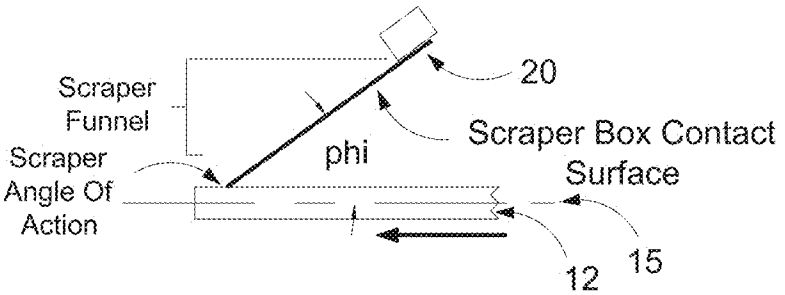
Figure 5C:
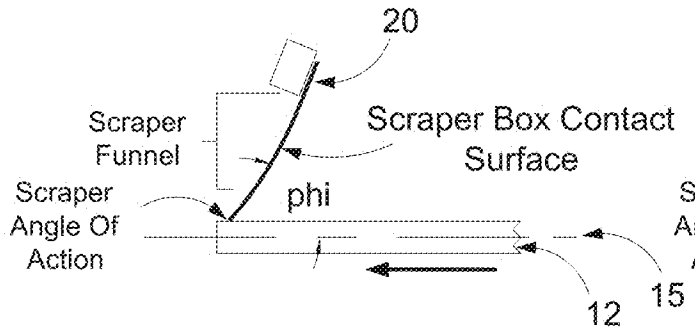
Figure 5D:
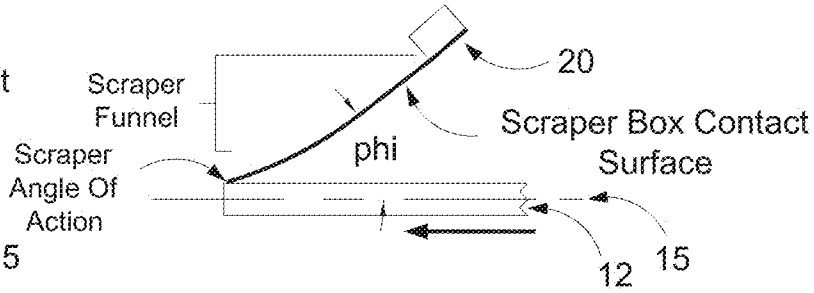

FIGS. 5A-5D depicts additional details of the Scrap Scraper 20. The Scraper Box Contact Surface is the upstream surface of the Scraper which makes contact with the Leading Edge of the Boxes and the Scrap. The angle (phi) between the tangent of the Scraper Box Contact Surface and the Board Line is the Scraper Angle, see FIG. 5A. The upper region of the Scraper Box Contact Surface is referred to as the Scraper Funnel with its average Scraper Angle referred to as the Scraper Funnel Angle 18. The angle of the Scraper Box Contact Surface at the Distinct Intersection Of Action is the Scraper Angle Of Action 19. A steep Scraper Angle Of Action refers to a larger angle (see FIG. 5A), whereas a shallow Scraper Angle Of Action is a smaller angle (See FIG. 5B). A harsh Scraper Funnel refers to a larger angle (FIG. 5A), where as a soft Scraper Funnel is a smaller angle (FIG. 5B).

The Scrap Resistance-Friction Phenomenon is possible if the Scraper Angle Of Action becomes too small. Therefore, ideally, the Scraper Angle Of Action should be relatively steep. This is shown for a substantially Rigid Nominally Linear Scrap Scraper in FIG. 5A and for a Flexible Nominally Linear Scrap Scraper in FIG. 5C. However, since the Boxes have Flaps that are sensitive to being bent backward the harsh Scraper Funnel associated with the steep Scraper Angle Of Action in FIG. 5A and 5C can be undesirable. To avoid bending Flaps a softer Scraper Funnel would be preferred as shown for a substantially Rigid Nominally Linear Scrap Scraper in FIG. 5B and for a Flexible Nominally Linear Scrap Scraper in FIG. 5D. The goal for the Nominally Linear Scrap Scraper to be both steep at the Scraper Angle Of Action and soft with the Scraper Funnel Angle presents a fundamental design conflict.

Figure 6A:
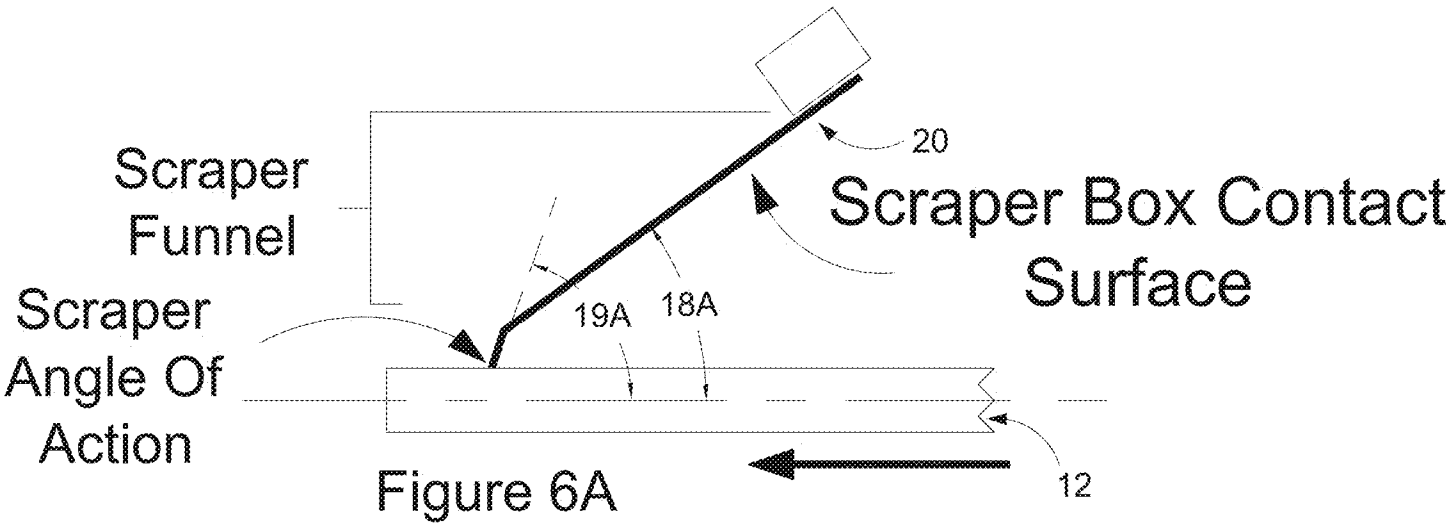
FIGS. 6A and 6B are side views of two embodiments of a Scrap Scraper with a soft Scraper Funnel and the steep Scraper Angle Of Action.
Figure 6B:
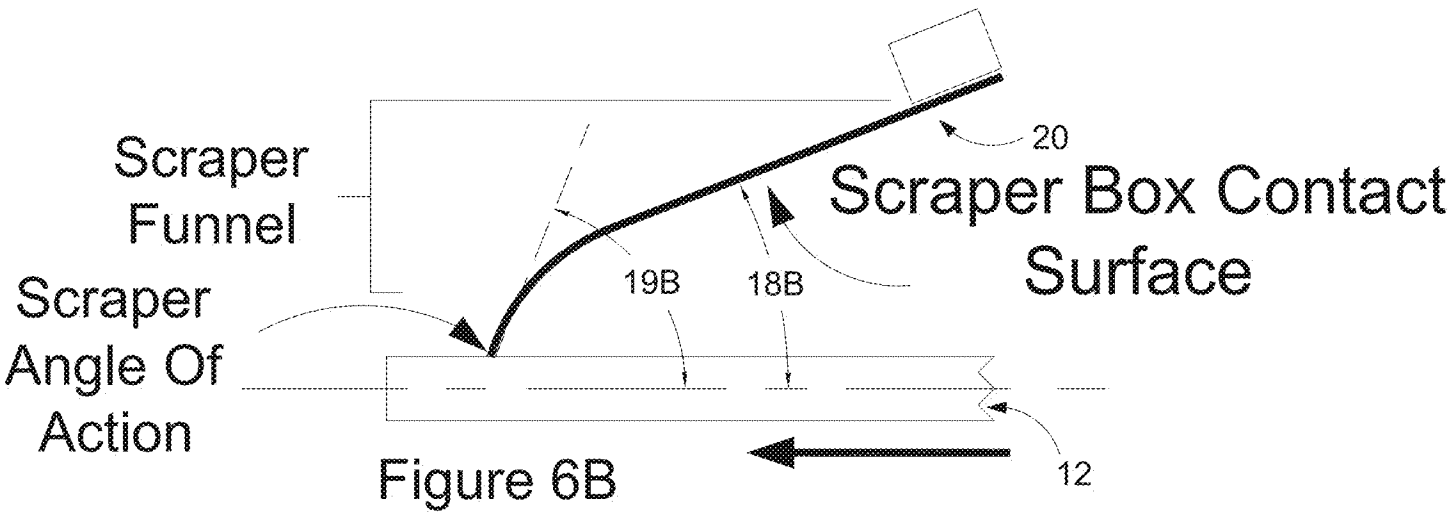
Figure 7B:
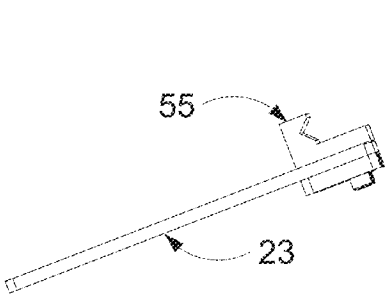
FIGS. 7A-7D are views of a Rigid Nominally Linear Scrap Scraper.
Figure 7A:
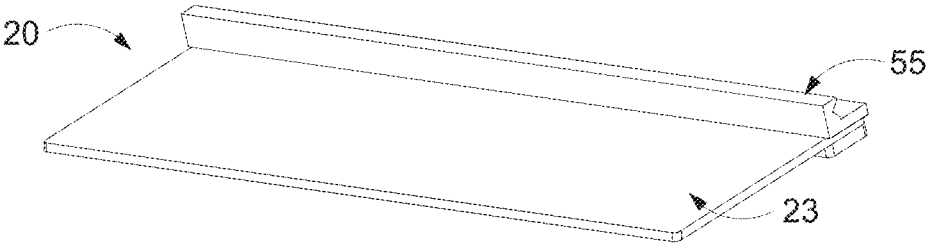
Figure 7D:
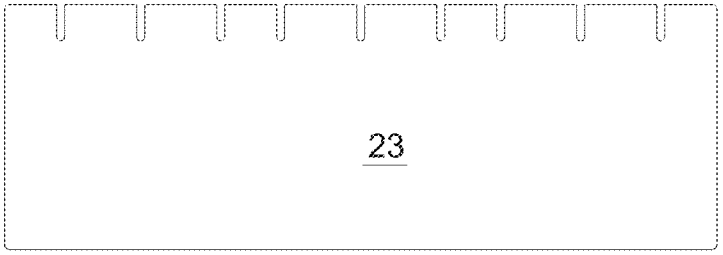
Figure 7C:
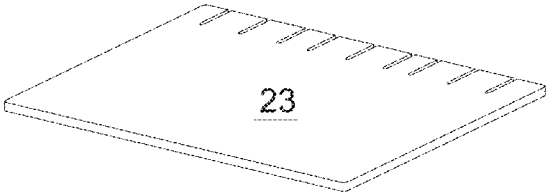
Figure 8B:
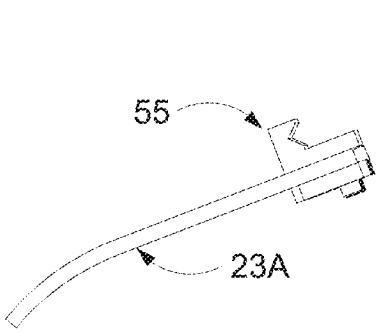
FIGS. 8A-8D are views of a Rigid Nominally Non-Linear Scrap Scraper.
Figure 8A:
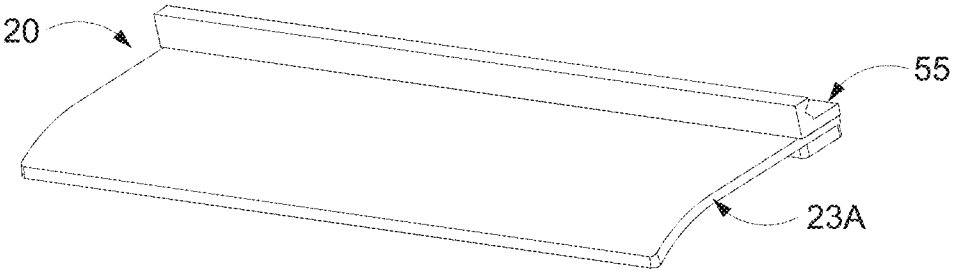
Figure 8C:
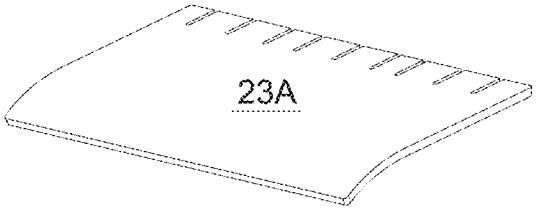
Figure 8D:
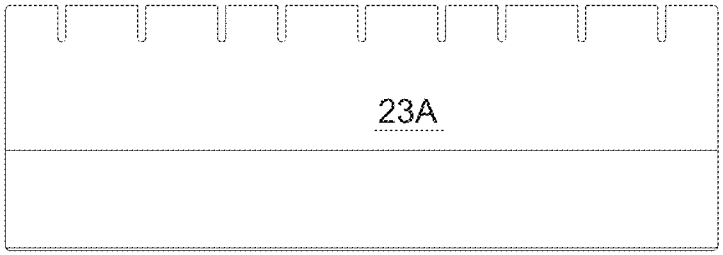
Figure 9A:
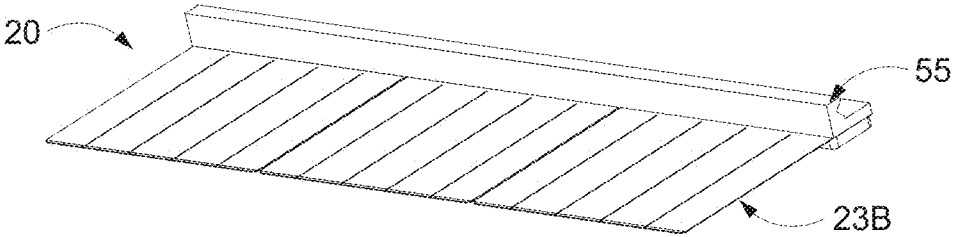
FIGS. 9A-9D are views of a Flexible Nominally Linear Scrap Scraper.
Figure 9B:
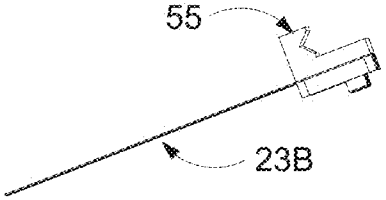
Figure 9C:
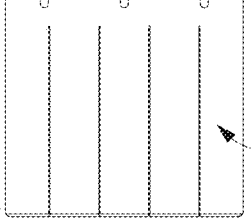
Figure 9D:
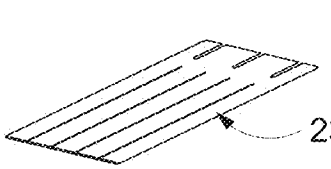
Figure 10B:
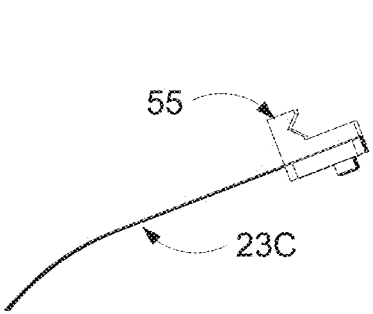
FIGS. 10A-10D are views of a Flexible Nominally Non-Linear Scrap Scraper.
Figure 10D:
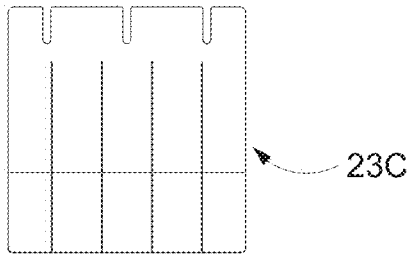
Figure 10A:
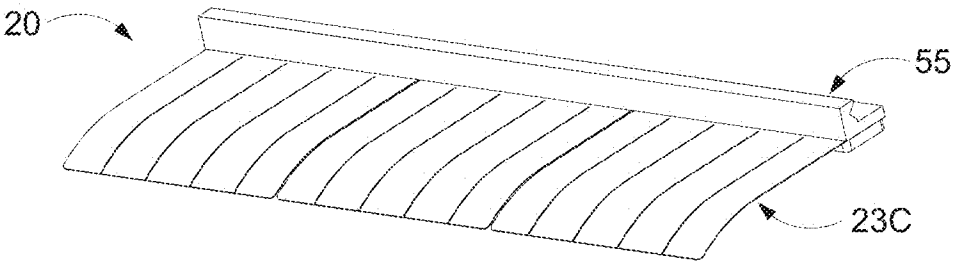
Figure 10C:
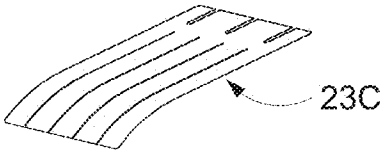
Figure 11A:
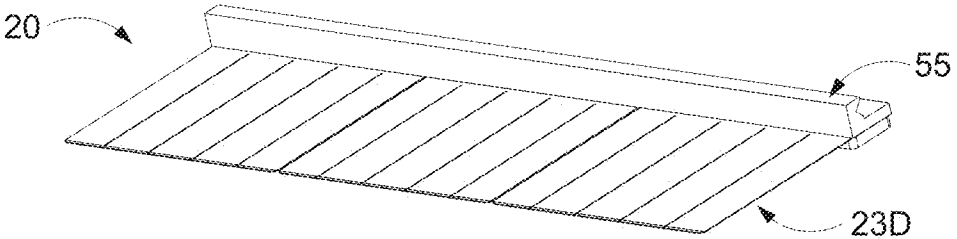
FIGS. 11A-11D are views of an Alternate Flexible Nominally Linear Scrap Scraper.
Figure 11B:
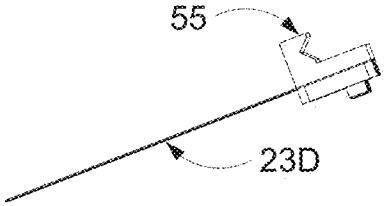
Figure 11C:
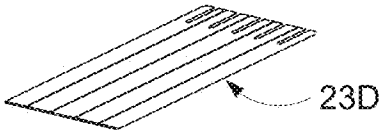
Figure 11D:
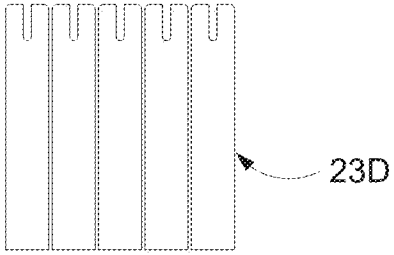
Figure 12B:
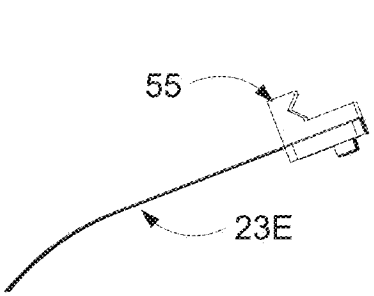
FIGS. 12A-12D are views of an Alternate Flexible Nominally Non-Linear Scrap Scraper.
Figure 12A:
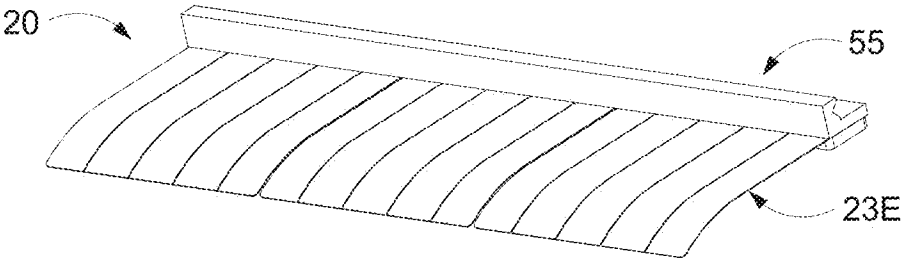
Figure 12C:
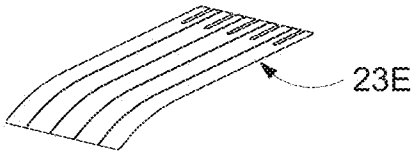
Figure 12D:
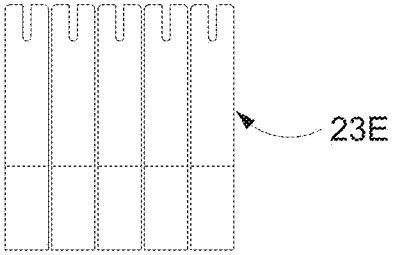

In order to solve this fundamental design conflict, a Scraper that has a smaller Scraper Angle in the Scraper Funnel area for a soft Scraper Funnel that is different than the desirable steep Scraper Angle Of Action in its nominal state gives the best of both worlds. There are multiple equivalent ways to achieve the resulting substantially Rigid Nominally Non-Linear Scrap Scraper, one shown in FIG. 6A in which a single bend is made to the Scraper in its nominal state. The length of the straight section defining the Scraper Angle Of Action 19A should be just long enough to allow a certain amount of Scrap buildup without experiencing the Scrap Resistance-Friction Phenomenon. This allows for a substantially softer Scraper Funnel Angle 18A. A second solution shown in FIG. 6B has a straight section in the Scraper Funnel region with a Scraper Funnel Angle 18B and then transitions to an arc at the end defining the Scraper Angle Of Action 19B. Again the geometry is selected to allow a relatively steep Scraper Angle Of Action and softer Scraper Funnel Angle so as to avoid both the Scrap Resistance-Friction Phenomenon and bending of Flaps.

The Scrap Scraper is positioned in the cross-machine direction and would typically have a width adequate to provide Scrap Separation to the maximum Corrugated Sheet Stock to be processed. Typically machinery found in Box Plants range from 80 inches to 150 inches but can be even larger.

FIGS. 7A-7D depict a Rigid Nominally Linear Scrap Scraper 20 having a base mount 55 and panel (or multiple panels) 23. FIGS. 8A-8D depict a Rigid Nominally Non-Linear Scrap Scraper 20 having a base mount 55 and panel (or multiple panels) 23A. One embodiment of the Rigid Nominally Linear Scrap Scraper (FIGS. 7A-7D), and the Rigid Nominally Non-Linear Scrap Scraper, (FIGS. 8A-8D) would be constructed as a geometric extrusion of the desired cross section. A geometric extrusion means the resulting part had the same desired cross section but could be actually manufactured using sheet metal, lamination, extrusion, molding or any other technique. There is no advantage of additional slitting or making from a plurality of smaller sections or parts other than to make multiple lengths shorter for ease of production and then assembling on the machinery.

FIGS. 9A-9D depict a Flexible Nominally Linear Scrap Scraper 20 having a base mount 55 and panel (or multiple panels) 23B. FIGS. 10A-10D depict a Flexible Nominally Non-Linear Scrap Scraper 20 having a base mount 55 and panel (or multiple panels) 23C. One embodiment of the Flexible Nominally Linear Scrap Scraper (FIGS. 9A-9D) and the Flexible Nominally Non-Linear Scrap Scraper (FIGS. 10A-10D) would be constructed as a geometric extrusion of the desired cross section or laser cut from plate spring steel material and formed into the desired cross section. Due to the flexibility of the Scrap Scraper, the preferred embodiment constructs the Scrap Scraper as sections of formed parts with the desired cross section with added slits in the through-machine direction from near the mounting end completely cut through the end which contacts the Boxes. This results in a plurality of relatively independent smaller Scrap Scraper Fingers which maintain all the benefits of a single full width Flexible Scrap Scraper but with the additional benefit that the Scrap Scraper Fingers can flex based on each Scrap Scraper Fingers' own interaction with the Box and Scrap. This allows for the natural variation in the path of the Boxes. This lets a Flap bent on the Die Board pass only deflecting the Scrap Scraper Fingers it impacts. Should partially glued liner come loose ahead of the Layboy, it may pass as well. It also allows the Scrap Scraper Fingers near the end of the Corrugated Stock Sheet edges to act more directly on the Edge Trim Scrap. In the preferred embodiment the Scrap Scraper Fingers are approximately 1 to 2 inch wide with a slot of approximately 1/16 inches. However, effective scrap scraping can be achieved with a variety of dimensionally combinations.

An alternate embodiment is to assemble a Flexible Scrap Scraper using a plurality of individual Scrap Scraper Fingers, as depicted in FIGS. 11A-11D for a Nominally Linear Scrap Scraper 20 having a nominally linear panel 23D and as depicted in FIGS. 12A-12D for a Nominally Non-Linear Scrap Scraper 20 having a nominally non-linear panel 23E.

The Scrap Scraper performs effective Scrap Separation in production running Rotary Die Cutters with Boxes containing substantial Scrap at production rates in a producing Box Plant for extended periods of time without excessive maintenance. Today's top production rates for Rotary Die Cutters producing Flat Boxes are around 200 Corrugated Sheet Stock processed per minute.

For a Rotary Die Cutter with a Die Board Circumference of 66 inches, common lengths of the Corrugated Sheet Stock are 25 inches to 60 inches. At 200 Corrugated Sheet Stock per minute, the Sheet Gap Time would be on the order of 186 milliseconds and 27 milliseconds respectively. If running a Corrugated Sheet Stock 50 inches long and converting to two 25 inch Ups using 20% Layboy Over Speed, the Up Gap Time would be on the order of 18 milliseconds with a Sheet Gap Time of 72 milliseconds. As the gap time gets very short it is not always possible for gravity alone acting on the Scrap to be able to move the Scrap from above the Box to below the Board Line.

Figures 13A, 13B, 13C:
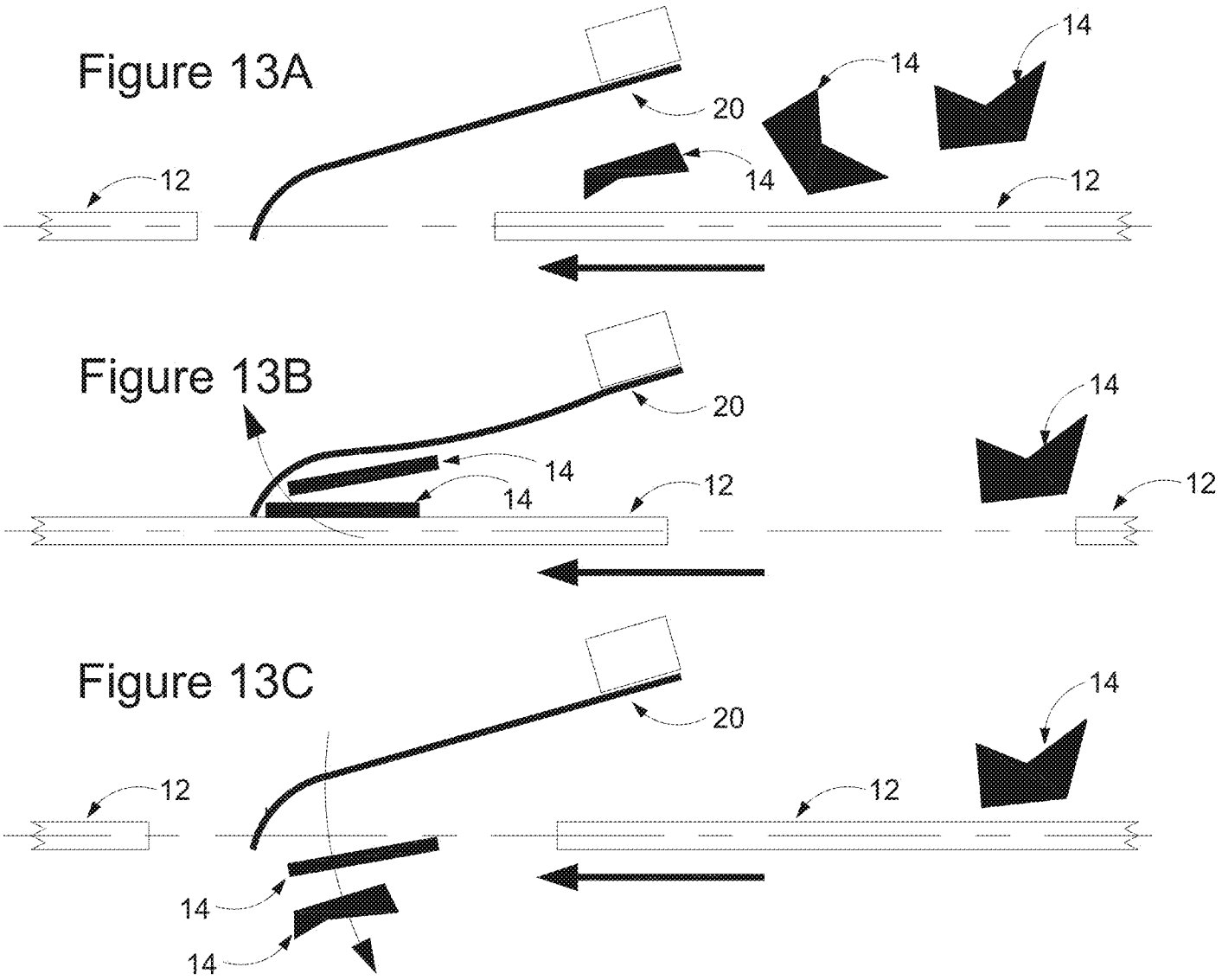
FIGS. 13A-13C are side views of a Flexible Nominally Non-Linear Scrap Scraper using Active Scrap Ejection to move Scrap from above the Boxes to below the Board Line in the gap between Boxes.

A Flexible Scrap Scraper, as depicted in FIGS. 13A-13C, combines the advantages of the Distinct Intersection Of Action with the ability of the Scraper, which starts out in a nominal position (see FIG. 13A), to then be preloaded by the energy provided by the Box against the Scraper Box Contact Surface(see FIG. 13B), and then once the gap between Boxes exists below the Distinct Intersection Of Action, the energy stored in the Flexible Scrap Scraper is used to actively force the Scrap down between either an Up Gap or a Sheet Gap (see FIG. 13C). This is referred to as Active Scrap Ejection. In order to achieve Active Scrap Ejection, the Scraper is made from a material, with size and proportions such that enough flexibility exists for the Scraping End to be nominally positioned below the Board Line and be able to flex up once the Box is present, storing enough energy to provide substantially Active Scrap Ejection and adequate Scraping Action but not so stiff as to overly deflect or damage the Box. A multitude of equivalent materials are applicable, including steel, plastics, fiber glass, and carbon fiber to name a few. In the one embodiment, spring steel was use for its durability, its ability to flex without permanent deformation and the ability to form an independent Scraper Funnel Angle and Scraper Angle Of Action. In the preferred embodiment the Distinct Intersection Of Action, the relatively steep Scraper Angle Of Action and soft Scraper Funnel and Active Scrap Ejection are combined in the Flexible Nominally Non-Linear Scrap Scraper.

The Corrugated Sheet Stock and orders come in a wide variety of sizes, shapes and amount of Scrap. In order to further improve the effectiveness of the Scrap Scraper 20 it is attached to vertical adjustment means to allow Variable Board Line Penetration, as depicted in FIGS. 14A-14B. For a given Scrap Scraper flexibility, increasing the Board Line Penetration (see FIGS. 14C & 14D) will increase both the Scraping Action and the strength and distance of the Active Scrap Ejection but also increase the impact on the Box and its ability to be transported. So increased Board Line Penetration may be required for larger, thicker boxes with substantial scrap, while a decrease in Board Line Penetration (see FIGS. 14A & 14B), may be preferred when running short, lightweight boxes with less Scrap. Note that FIGS. 14A and 14C show Scrap Scraper 20 prior to engagement with box 12 so that Scrap Scraper 20 is not flexed. In FIG. 14C, Scrap Scraper 20 extends below the board line 15 more than Scrap Scraper 20 in FIG. 14A. FIGS. 14B and 14D show Scrap Scraper 20 during engagement with box 12 so that Scrap Scraper 20 is flexed. FIG. 14D shows the Scrap Scraper 20 with greater flexing of the Scrap Scraper 20 than in FIG. 14B.

Figure 15B:
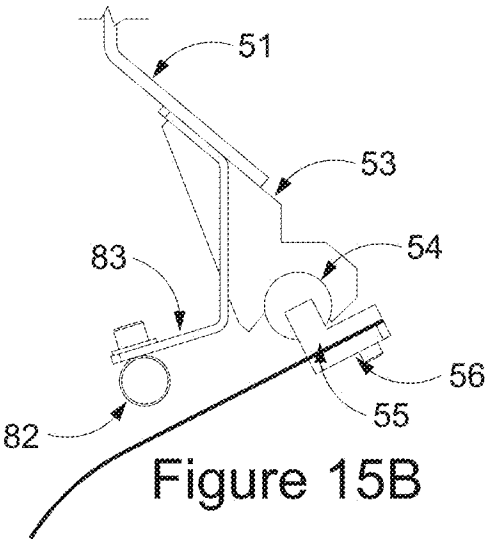
FIGS. 15A-15C depict a means for Variable Scraper Stiffness.
Figure 15C:
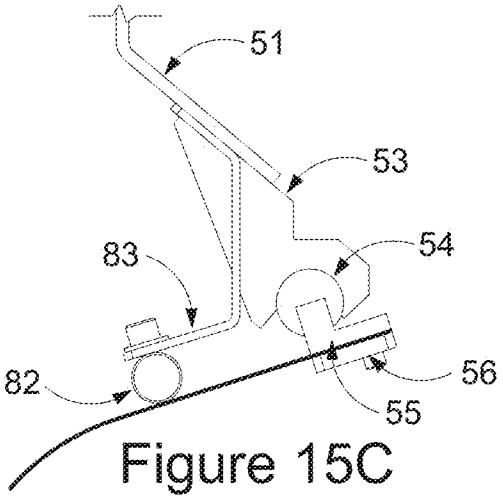
Figure 15A:
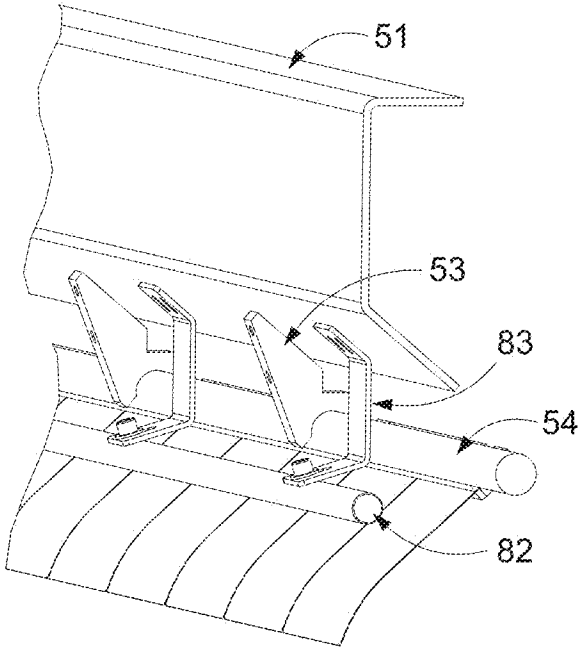

The Variable Board Line Penetration provides the benefit of being able to increase/decrease both the Scraping Action and the strength and distance of the Active Scrap Ejection simultaneously, with a variable impact on the Box and its ability to be transported. It is desirable to change the Flexible Scrap Scraper Stiffness but one can not change a static function such as the Scrap Scraper construction. However, an effective change in flexibility, referred to as Variable Scraper Stiffness is possible by means which allow the same Flexible Scrap Scraper to experience two or more different Support Systems. In one embodiment there are two selectable Support options for the Flexible Scrap Scraper. The first Support option has the Scrap Scraper cantilevered by one end only at the Scraper Base Mount 55, as depicted in FIG. 15B. The second option is cantilevered on one end and has a simple support 82 between the cantilevered support and the Scraping End, as depicted in FIG. 15C. Note that FIG. 15A shows a different perspective of the apparatus depicted in FIGS. 15B and 15C. In one embodiment the cantilevered end is rotated causing the Flexible Scraper to select between the two Support Systems. This motion along with vertical adjustment allows selecting the same Board Line Penetration but with a different Scrap Scraper Stiffness, as depicted in FIGS. 16A-16C.

More details of the apparatus for achieving variable board line penetration are depicted in FIGS. 17A, 17B, 17C, 17D, 18A, 18B, 19A, 19B, 20A, 20B, 20C, 20D, 21A, 21B, 22A, 22B, 22C, and 22D. The powered Scrap Scraper Adjustment Apparatus allows the adjustments to be done remotely or automatically using well known computer controlled automation technology. Alternatively an equivalent manually adjustable means could be implemented. The scraper motion mechanism 50, shown in FIG. 18A, consists of a scraper motion frame 51 which houses most of the mechanism and is operably connected to the scrap scrapers 20 by the scraper pivot shaft holders 53, the scraper pivot shaft 54, the scraper base mount 55 and scraper clamp bars 56 (see FIG. 23B). The scraper motion frame 51 has a scraper motion frame cover 57 to protect the mechanisms held within. The mechanisms within the scraper motion frame 51 are controlled by a linear actuator 58 with integral position feedback. In this case an off the shelf electrical motor/lead screw combination with a built in potentiometer is shown but other standard linear actuators may be applied. Programmable controls extends and retracts changing the length of the linear actuator 59, shown in FIG. 22D, using commonly available computer controlled technology. This linear actuator stroke distance 59 in turn changes the scraper motion vertical position 52 of the scraper motion frame 51 which in turn allows for the variable board line penetration.

For the following description of the scraper motion mechanism 50, the term cam follower will be used frequently and is understood to be essentially a wheel with an axle mounted to allow various types of relative mechanical motion.

The scraper motion mechanism 50 is attached to the framework of the layboy machine with slide mounts 60', 60" located at each end of the scraper motion frame 51. These slide mounts 60', 60" are each made from assembling two parts, the slide mount verticals 61', 61" and the slide mount angles 62', 62" as shown in FIG. 20A, 20B, 20C and 20D. The scraper motion frame 51 has scraper motion frame end caps 77', 77" with clearance slots 78', 78" to allow clearance for slide mount angles 62', 62" and the full scraper motion vertical position travel 52. The slide mount verticals 61', 61" have a slot 63', 63" for accepting pairs of cam followers 64', 64" which have their axle attach to scraper motion frame end caps 77', 77" and wheels constrained by the slots 63', 63" in the slide mount verticals 61', 61".

Figure 19A:
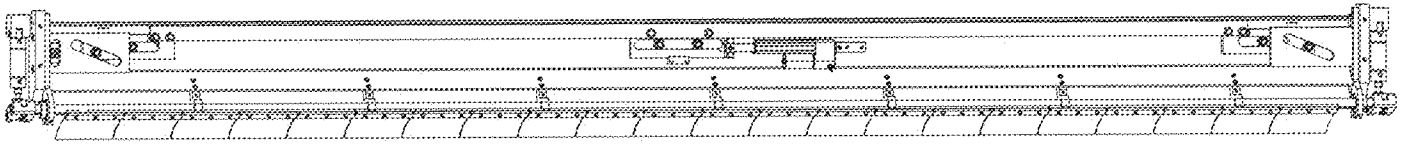
FIG. 19A is different 3D view of means for Variable Board Line Penetration and Variable Scraper Stiffness with guarding removed for clarity.
Figure 19B:
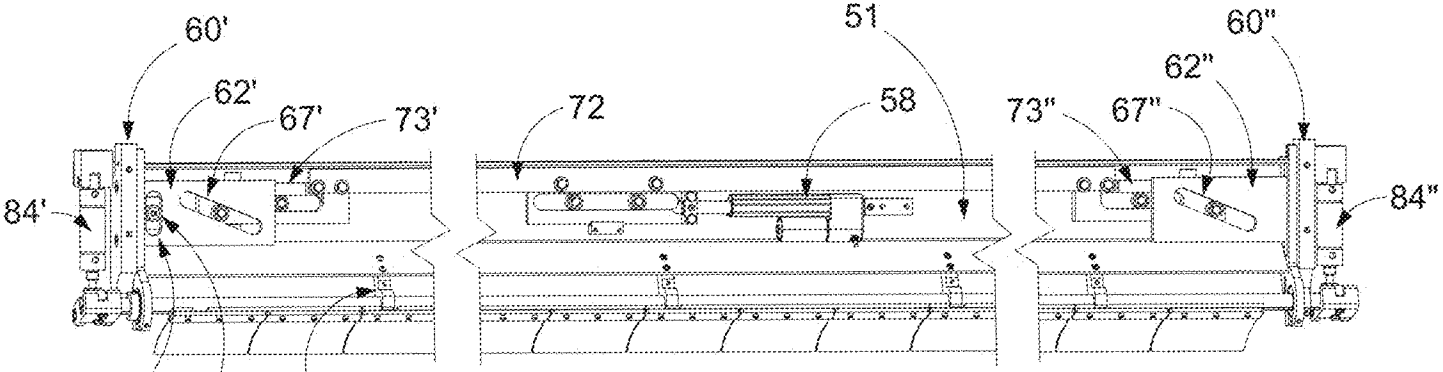
FIG. 19B is a broken view for a zoomed in view of the mechanisms that allows the Variable Board Line Penetration and Variable Scraper Stiffness.
Figure 20B:
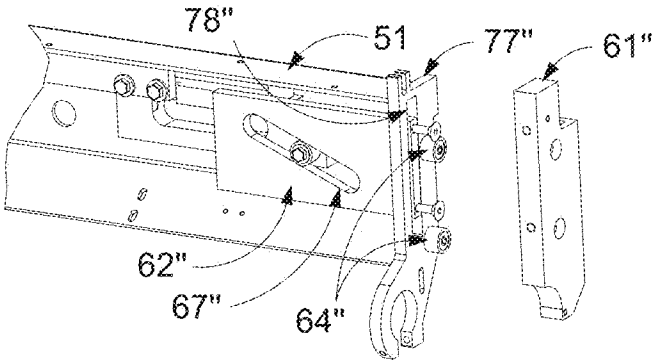
FIG. 20A-20D are detailed 3D views of vertical slides associated with the means for Variable Board Line Penetration.
Figure 20D:
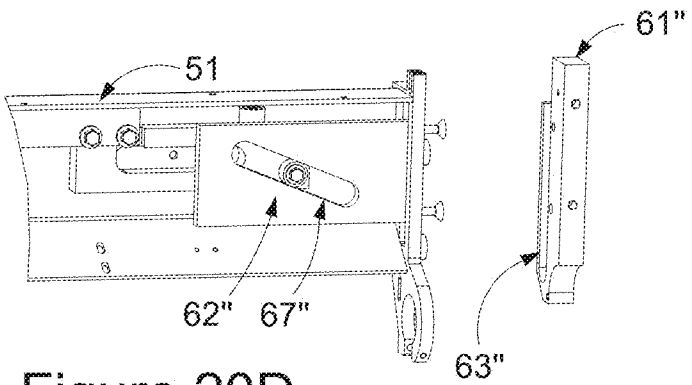
Figure 20A:
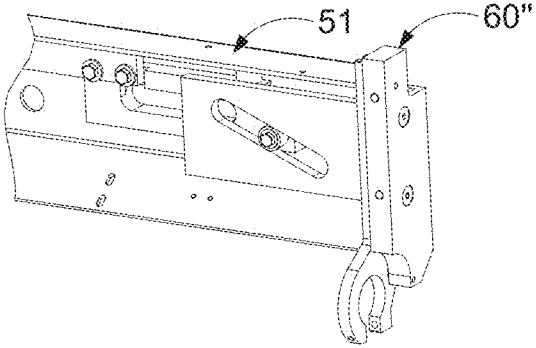
Figure 20C:
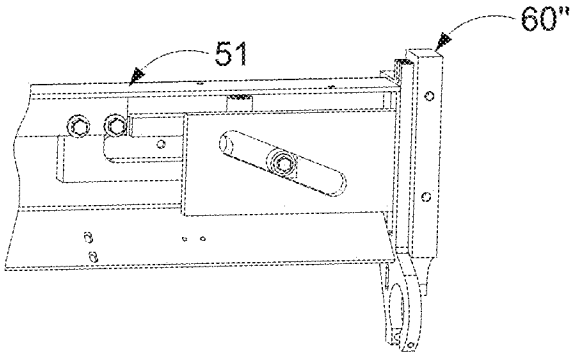
Figure 21A:
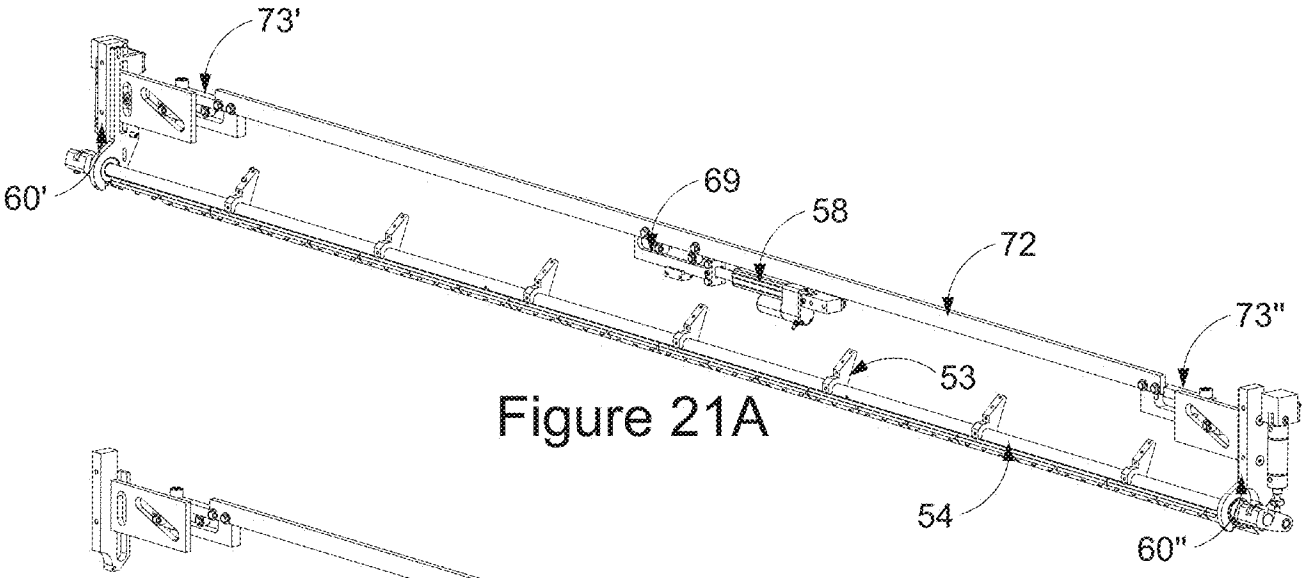
FIG. 21A is a 3D view of just the internal mechanisms associated with the means for Variable Board Line Penetration and Variable Scraper Stiffness with the Scrapers attached.
Figure 21B:
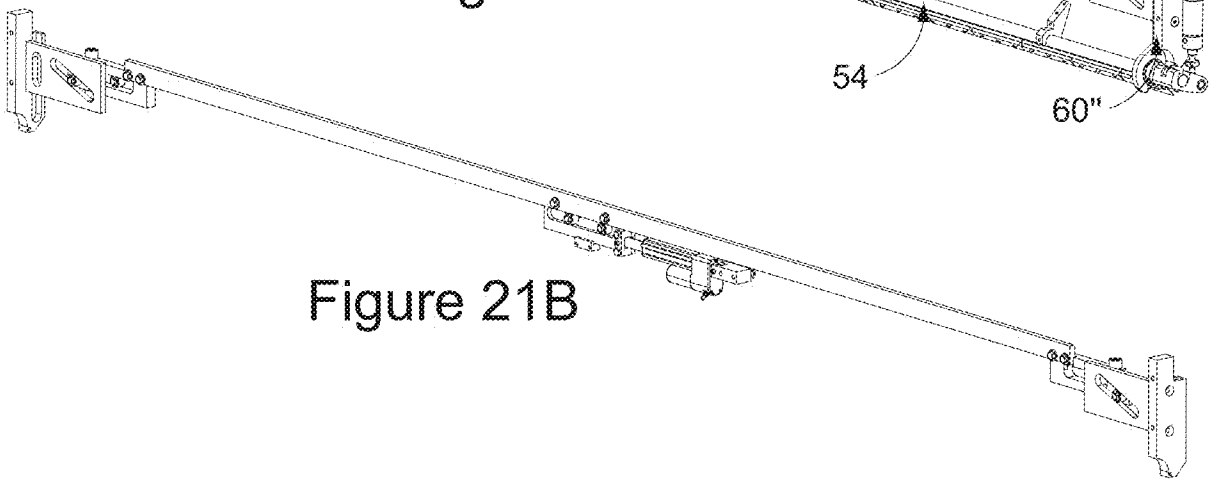
FIG. 21B is a 3D view of just the internal mechanisms associated with the means for Variable Board Line Penetration only.

On one end, see FIG. 19B, the slide mount angles 62' has a vertical slot 65. This slot accepts a single cam follower (66) with it axle attach to scraper motion frame 51.

Both slide mount angles 62', 62" have an angle slot 67', 67" which allow actuated relative motion of the scraper motion frame (51) to the slide mounts 60', 60" and consequently the layboy framework. The linear actuator 58 has one end mounted to the scraper motion frame 51 using a mounting block 68 and the other end attached to a horizontal slide 69, as shown in FIG. 22D. The horizontal slide 69 has a horizontal slot 81 and is constrained by a pair of cam followers 70 which have their axles attached to the scraper motion frame 51 and are inserted into the horizontal slide 69. A guide block 71 also constrains the horizontal slide 69. A tie bar 72 is directly coupled to the horizontal slide 69 and on each end to the horizontal-vertical motion assemblies 73', 73".

Figure 22B:
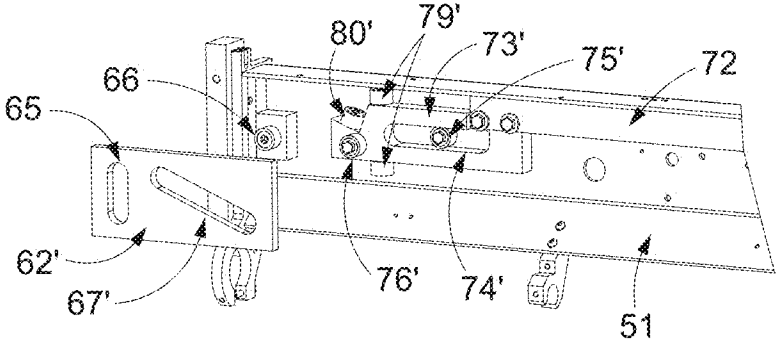
FIGS. 22A and 22B are 3D views of end of scraper motion frame with 22B shown in exploded view for clarity.
Figure 22A:
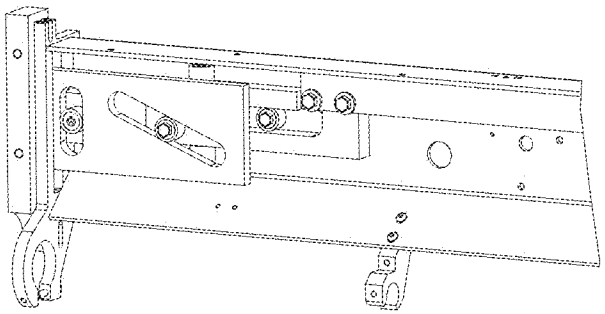
Figure 22D:
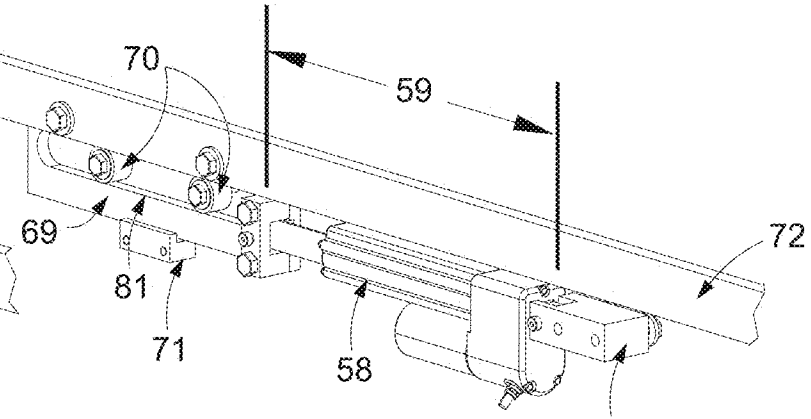
FIGS. 22C and 22D are zoomed in view of items shown in FIG. 21B.
Figure 22C:
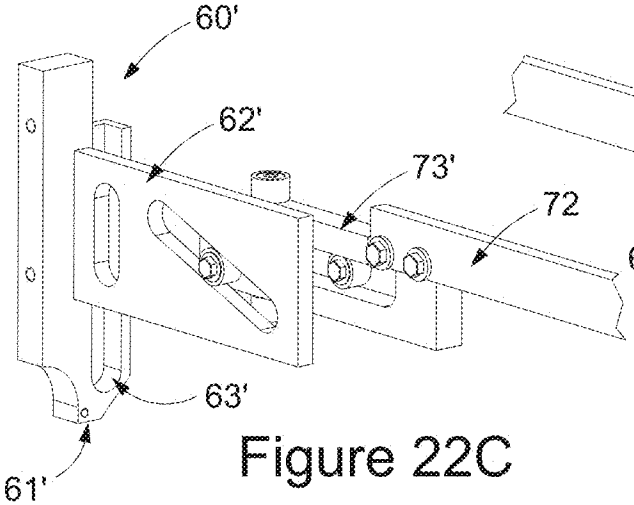

The horizontal-vertical motion assemblies 73', 73" have a horizontal slot 74', 74" for accepting a cam follower 75', 75" with its axle attached to the scraper motion frame 51 as shown in FIG. 22B. These two cam followers along with the constrained motion of the tie bar 72 constrain both horizontal-vertical motion assemblies 73', 73" to only move in the single direction corresponding to the motion direction of the linear actuator 58. Spacer cam followers 79', 79" keeps a rolling gap between horizontal-vertical motion assemblies 73', 73" and the scraper motion frame 51. Spacer cam followers 80', 80" keeps a rolling gap between horizontal-vertical motion assemblies 73', 73" and the slide mount angles 62', 62". The cam followers 76', 76" have their axles attached to the horizontal-vertical motion assemblies 73', 73" and their wheels in angle slots 67', 67" of slide mount angles 62', 62". The result is the translation of the motion of as horizontal-vertical motion assemblies 73', 73" to cause the slide mounts 60', 60" to move relative to scraper motion frame 51 and thus allowing control of the scraper motion vertical position 52.

The scraper motion mechanism 50 allows the adjustments to be done remotely and/or automatically using well known computer controlled automation technology. There are multiple equivalent means which will provide automatic control of Variable Board Line Penetration. Alternatively an equivalent manually adjustable means could be implemented.

Figure 17C:
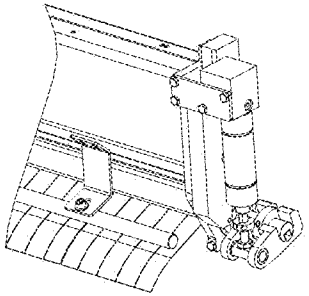
FIGS. 17C and 17D depict another logical view of the Variable Board Line Penetration and Variable Scraper Stiffness apparatus.
Figure 17D:
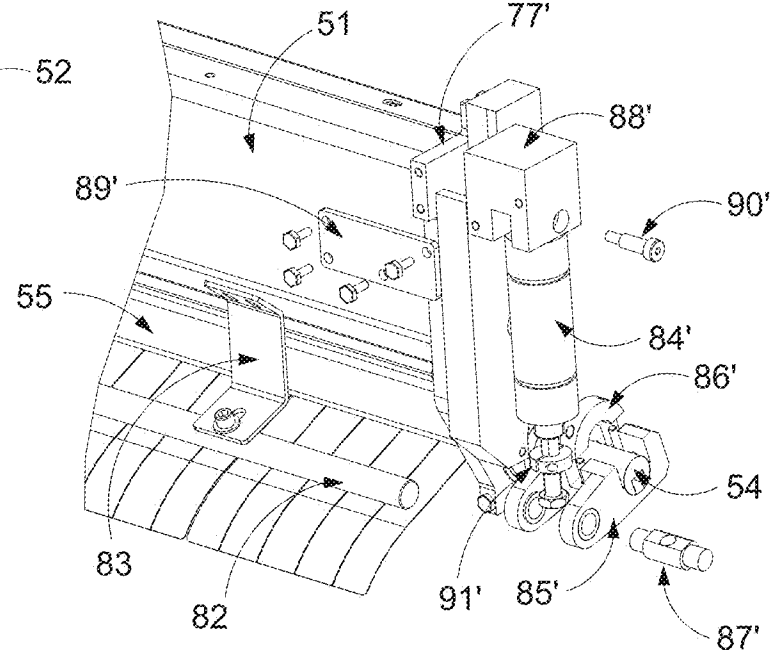
Figure 17B:
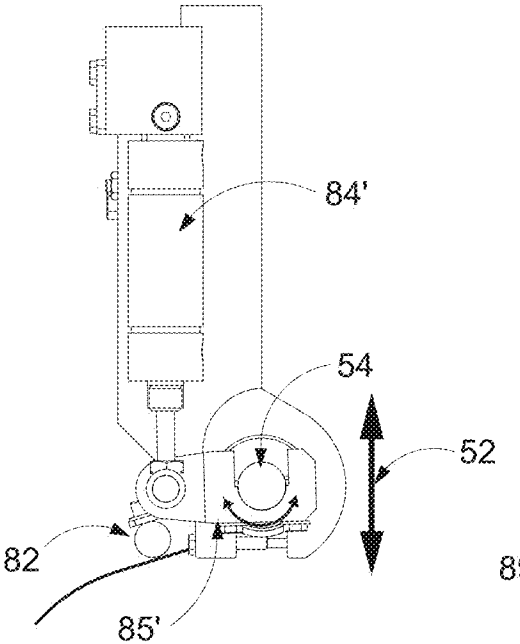
FIGS. 17A and 17B are side views of a means for Variable Board Line Penetration and Variable Scraper Stiffness.
Figure 17A:
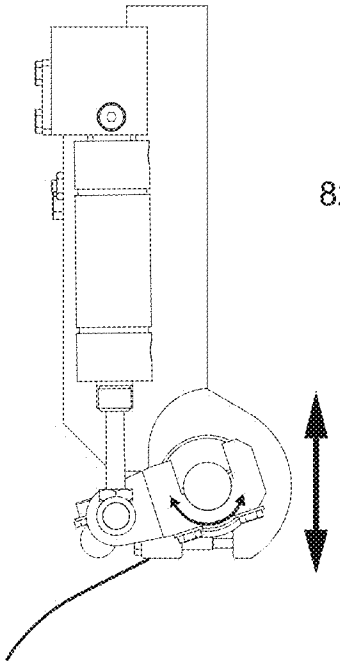
Figure 18A:
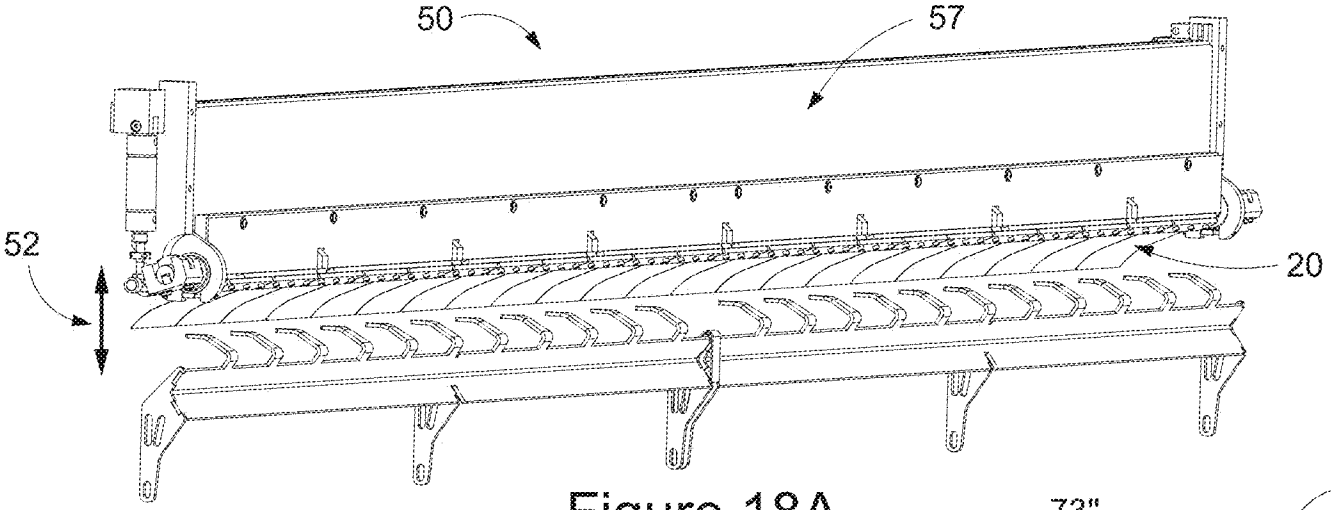
FIG. 18A is 3D view of means for Variable Board Line Penetration and Variable Scraper Stiffness including a bottom support means for the box.
Figure 18B:
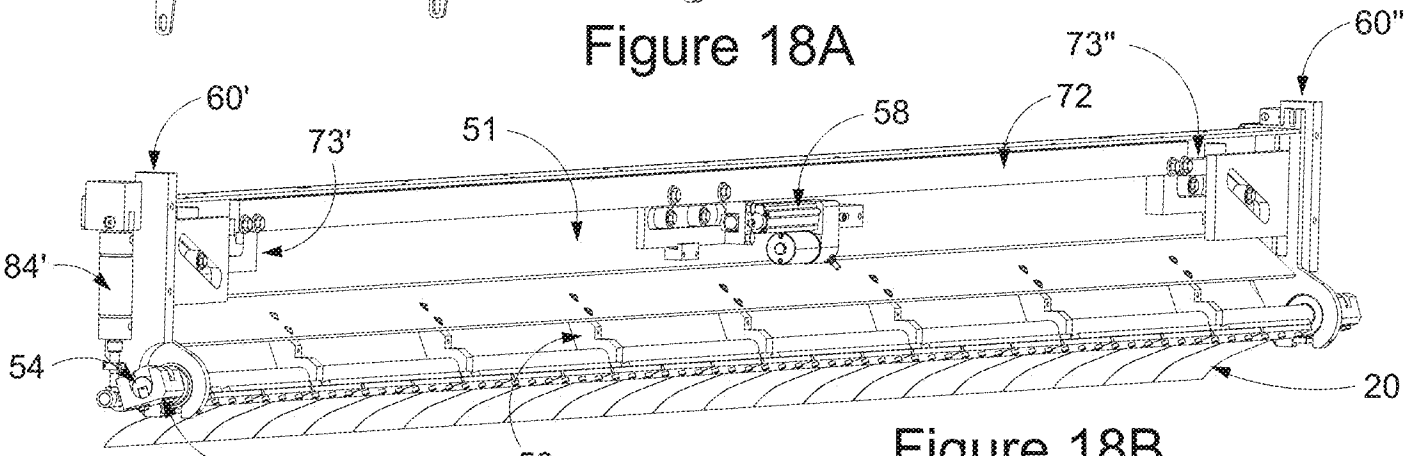
FIG. 18B is the same view but the cover exposing the mechanisms that allows the Variable Board Line Penetration motion has been removed and the bottom support means for the box has been removed.

Secondary scraper support bar 82 is connected to scraper motion mechanism 50 by brackets 83 as shown in FIG. 17D. Rotation of scraper pivot shaft 54 from the position shown in FIG. 15B to position shown in FIG. 15C changes the Support Systems for the Flexible Scrap Scraper thus creating Variable Scraper Stiffness.

The scraper pivot shaft 54 is operably connected to pivot cylinders 84', 84". The base of the pivot cylinders 84', 84" are connected to the scraper motion frame 51 by cylinder mount blocks 88', 88" and cylinder mount plates 89', 89" with pin 90', 90". The angle of the scraper pivot shaft 54 is controlled by the connection of lever brackets 85', 85" which are connected directly to scraper pivot shaft 54 with clamps 86', 86". Rotation rod pin 87', 87" allow the rod end of pivot cylinders 84', 84" to connect to the lever brackets 85', 85". Stroke clamps 91', 91" can optionally be added to give fine control over cylinder stroke length. There are a variety of equivalent means to achieve selectable Support Systems.

Since the Simple Support, the round pivot shaft and the Pivot Cylinders are all also mounted to the primary frame of the Scrap Scraper Adjustment Apparatus, the vertical adjustment which allows Variable Board Line Penetration is independent of the selection of Support Systems allowing Variable Scraper Stiffness.

Figure 23A:
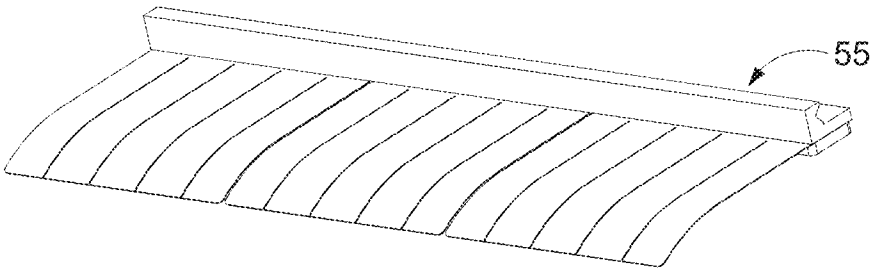
FIGS. 23A and 23B are views of assembling the Scrap Scraper to the Scrap Scraper Base Mount.
Figure 23B:
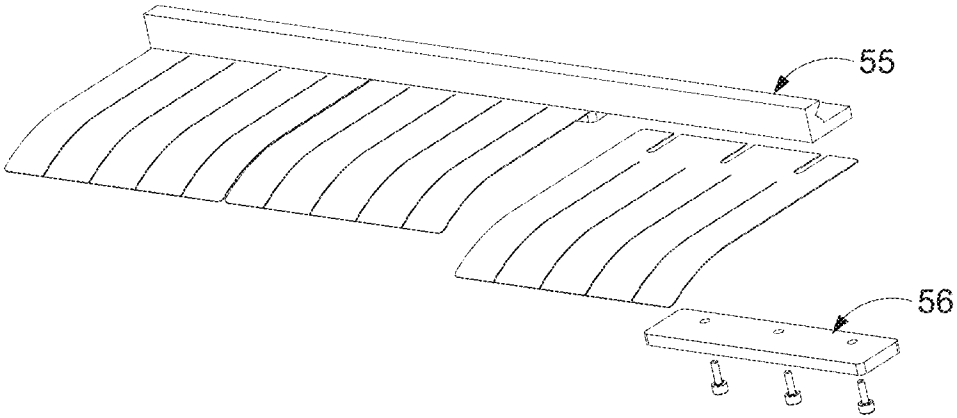

FIGS. 23A and 23B show one embodiment of a Flexible Nominally Non-Linear Scrap Scraper and how it attaches to the Scrap Scraper Base Mount 55.

As the Scrap is being separated from the Boxes and ejected below the Board Line it is preferred to give the Scrap ample opportunity to exit away from the transporting surfaces. A Scrap Exit Opening runs laterally across the width of the machine, providing either a single opening or a substantially uninterrupted set of openings generally located below the Scraping Action of the Scrap Scraper allows for the Scrap to exit the Board Line area. The Scrap Exit Opening consists of an upstream Box Lateral Support and downstream Box Lateral Support to support the Boxes during the Scraping Action. The Box Lateral Support can be part of the transport system, a fixed surface or an overhead vacuum system. The lateral support provided can be continuous or a plurality of narrower supports or suction.

Figure 24:
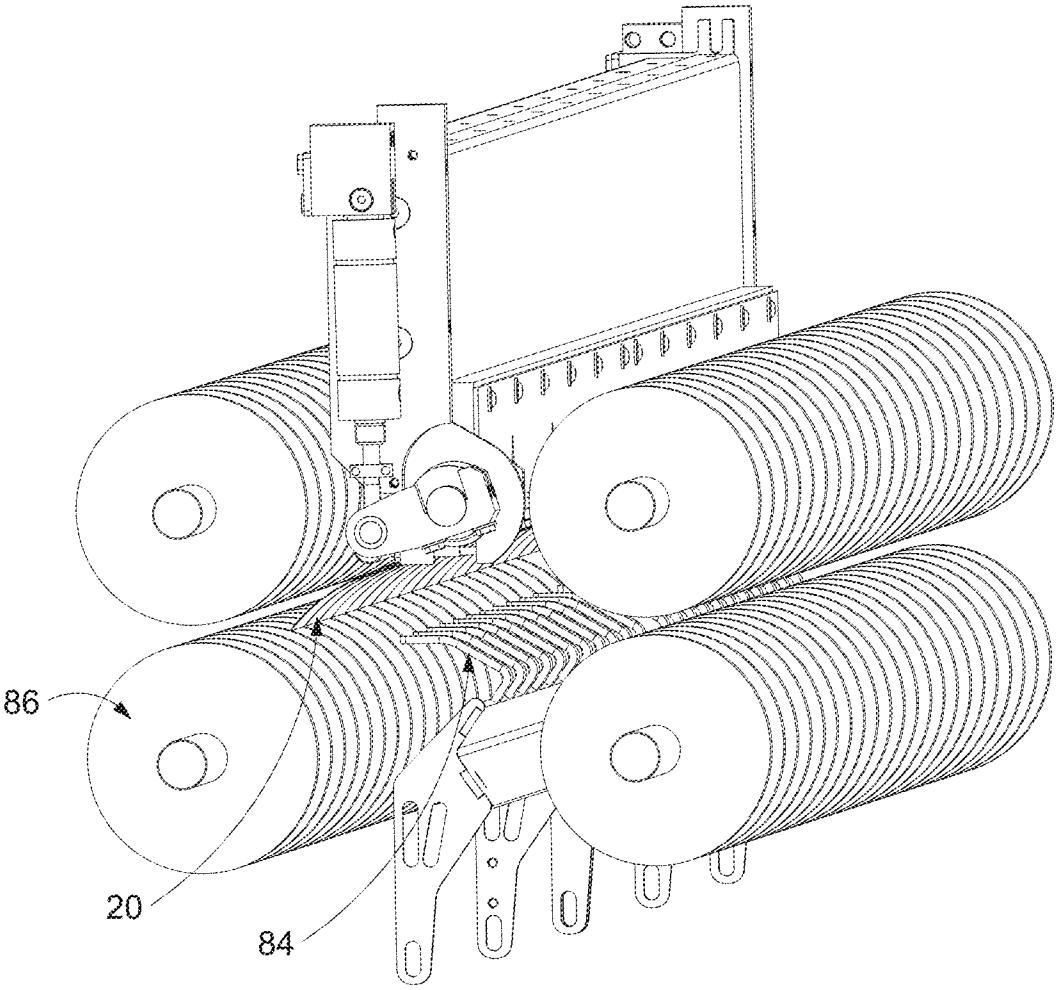
FIG. 24 is a 3D view of one embodiment of the Scrap Exit Opening.
Figure 25:
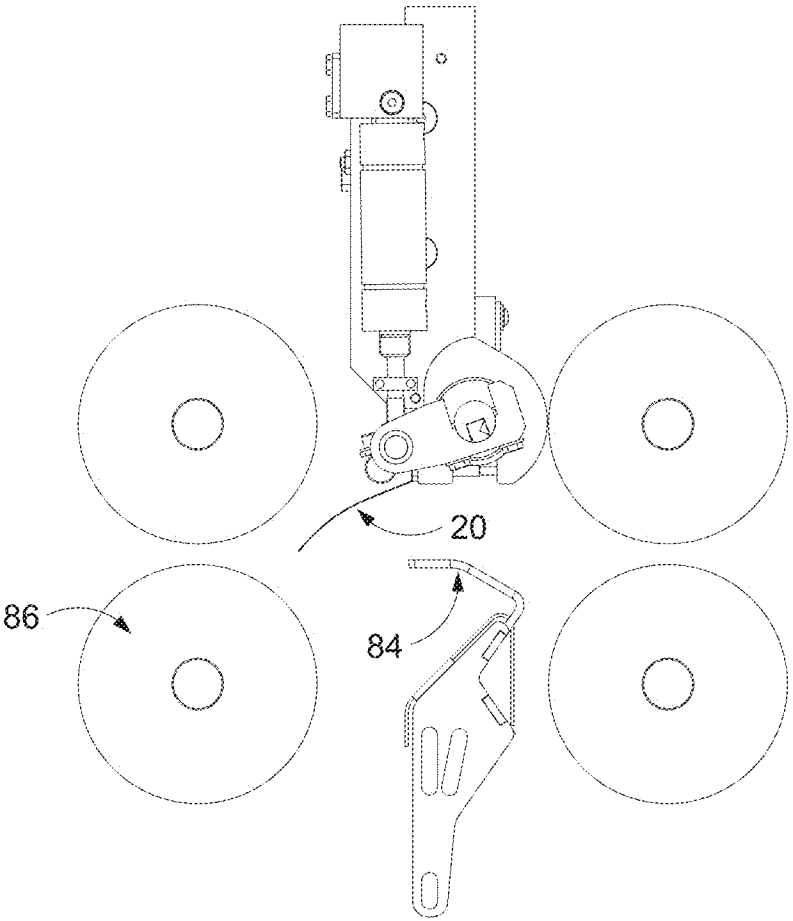
FIG. 25 is a side view of one embodiment of the Scrap Exit Opening.
Figure 26:
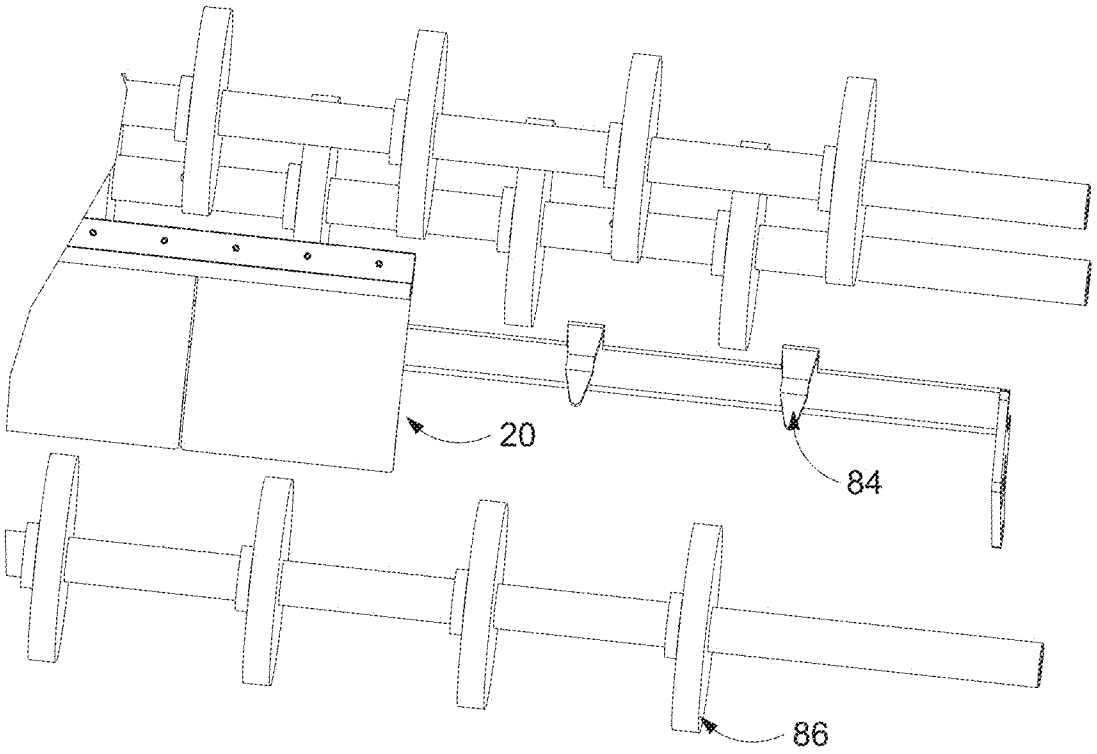
FIG. 26 is a somewhat top view 3D view of the one embodiment of the Scrap Exit Opening with the top downstream wheel assembly removed for clarity.
Figure 27A:
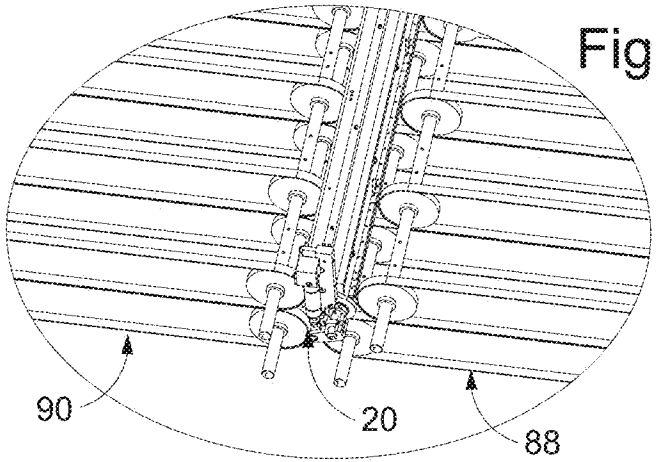
FIGS. 27A and 27B are 3D views of an alternate embodiment of the Scrap Exit Opening.
Figure 27B:
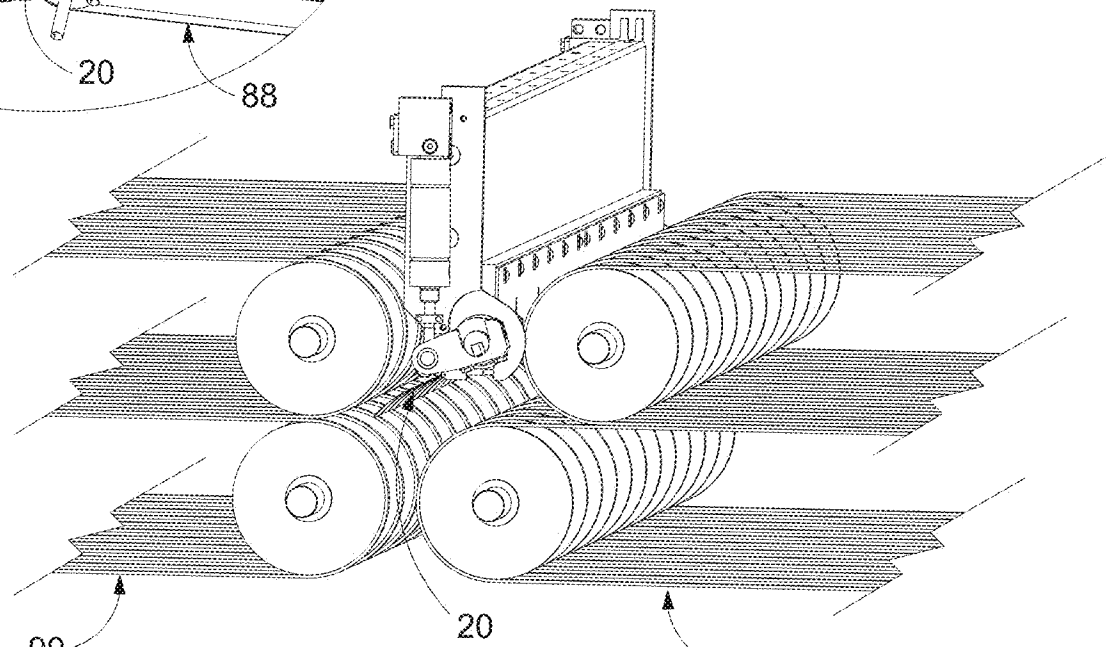
Figure 28:
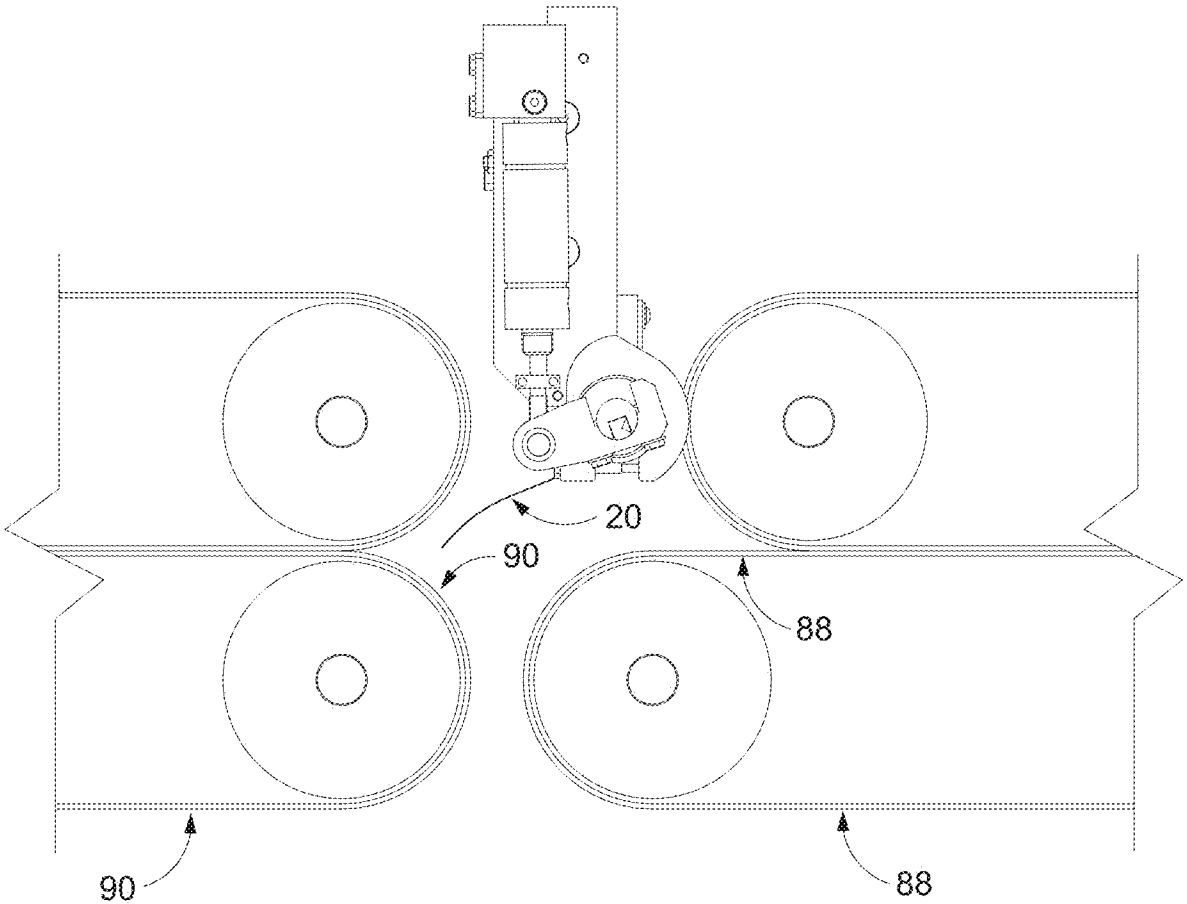
FIG. 28 is a side view of an alternate embodiment of the Scrap Exit Opening shown in FIGS. 27A and 27B.
Figure 29:
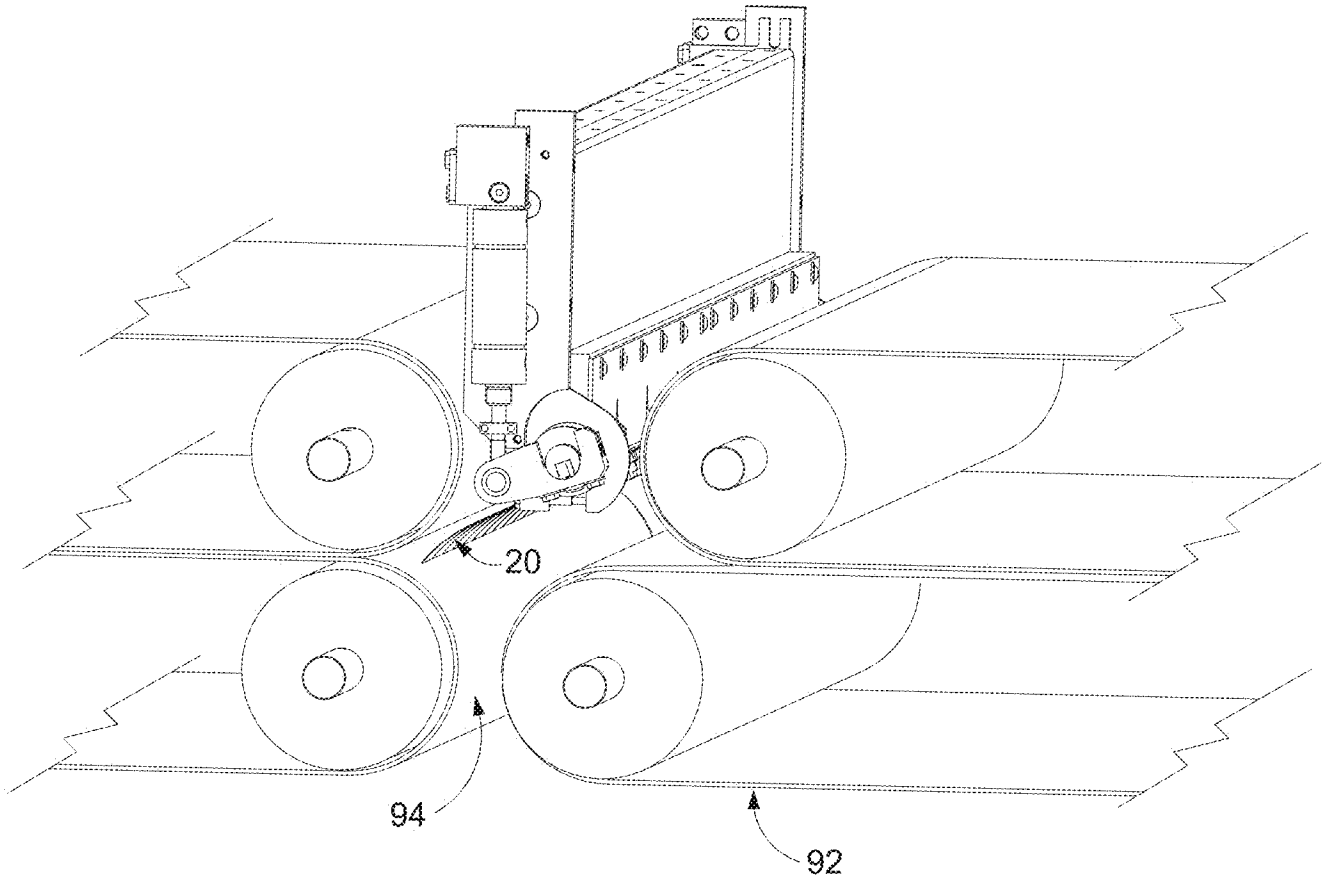
FIG. 29 is a 3D view of an alternate embodiment of the Scrap Exit Opening.
Figure 30:
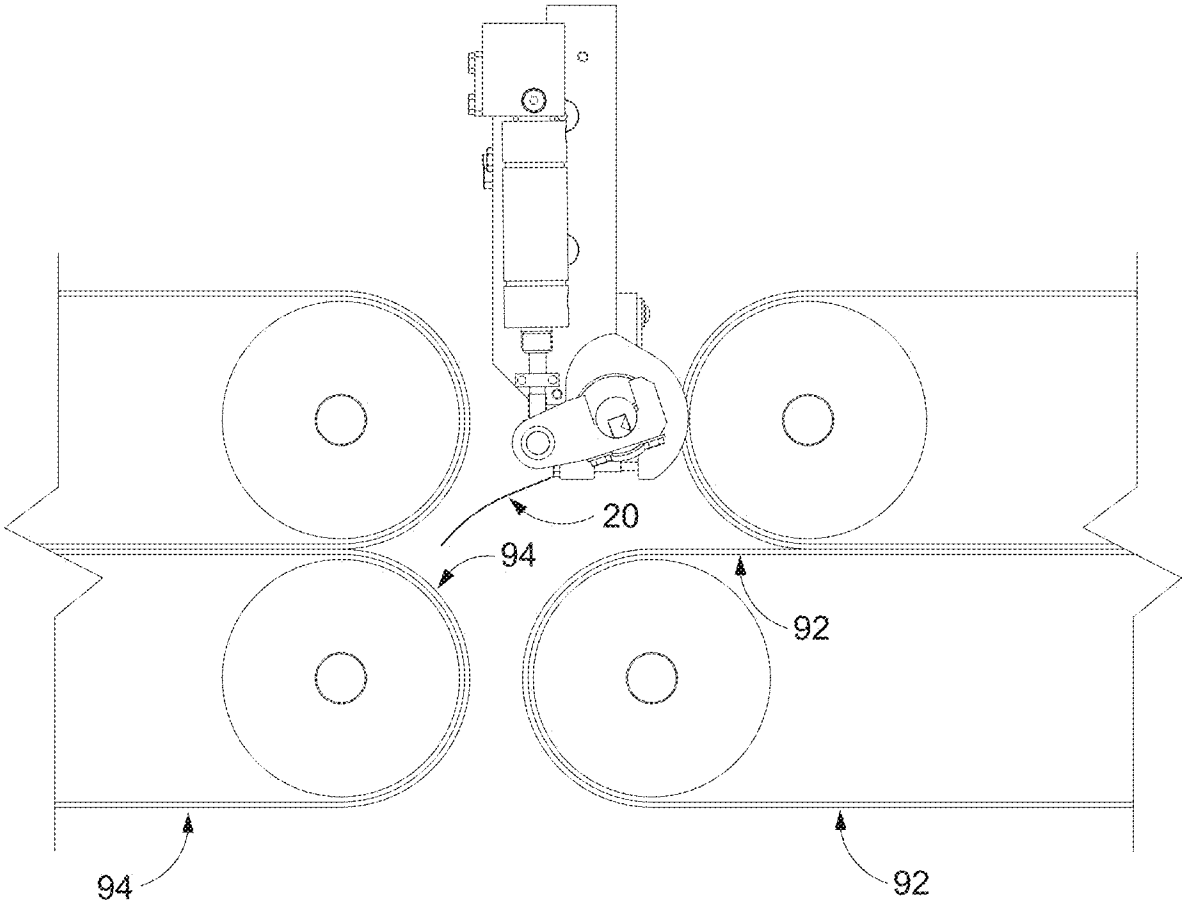
FIG. 30 is a side view of an alternate embodiment of the Scrap Exit Opening shown in FIG. 29.
Figure 31:
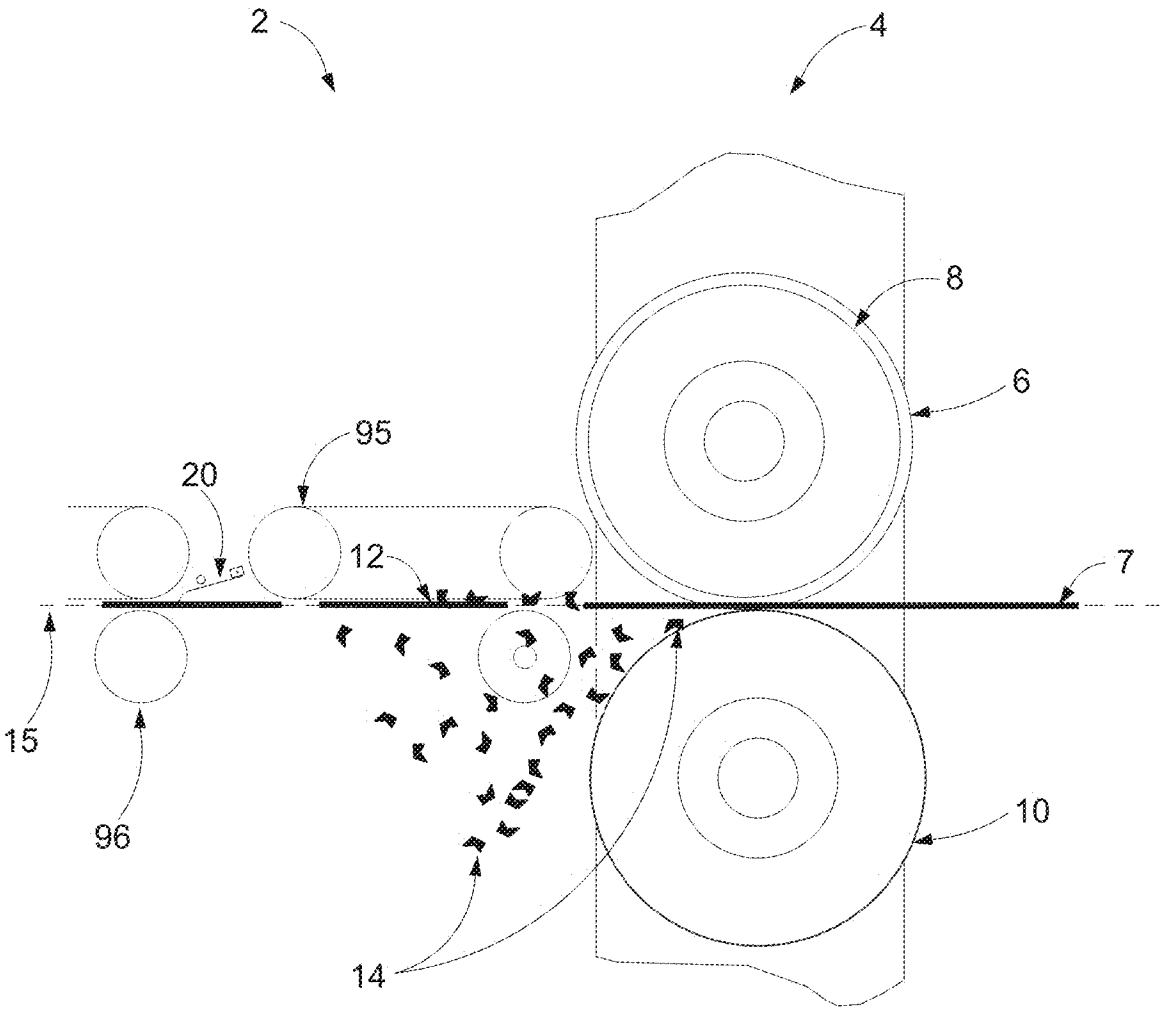
FIG. 31 is a side view of an alternate embodiment of the Scrap Exit Opening.

In one embodiment illustrated in FIGS. 24, 25 and 26, the Scrap Scraper has an upstream Box Lateral Support 84 which is fixed to the machine with full lateral support. The upstream Box Lateral Support has angles to help funnel the Leading Edge of the Boxes and Flaps towards the Board Line. It is manually adjustable in the vertical direction. The downstream Box Lateral Support is a Wheel Assembly 86 which also provides transport to the Boxes. The plurality of wheels allow extra space for the Scrap to fall. An alternate embodiment includes but is not limited to FIGS. 27A, 27B and 28, in which the upstream Box Lateral Support is a transporting plurality of narrow Conveyors 88 and the downstream Box Lateral Support is a transporting plurality of narrow Conveyors 90. An alternate embodiment includes but is not limited to FIGS. 29 and 30, in which the upstream Box Lateral Support is a transporting single wide Conveyor 92 and the downstream Box Lateral Support is a transporting single wide Conveyor 94. An alternate embodiment includes but is not limited to FIG. 31, in which the upstream Box Lateral Support is an Overhead Vacuum transporting system 95 and the downstream Box Lateral Support is a transporting Roller 96.

Figure 32:
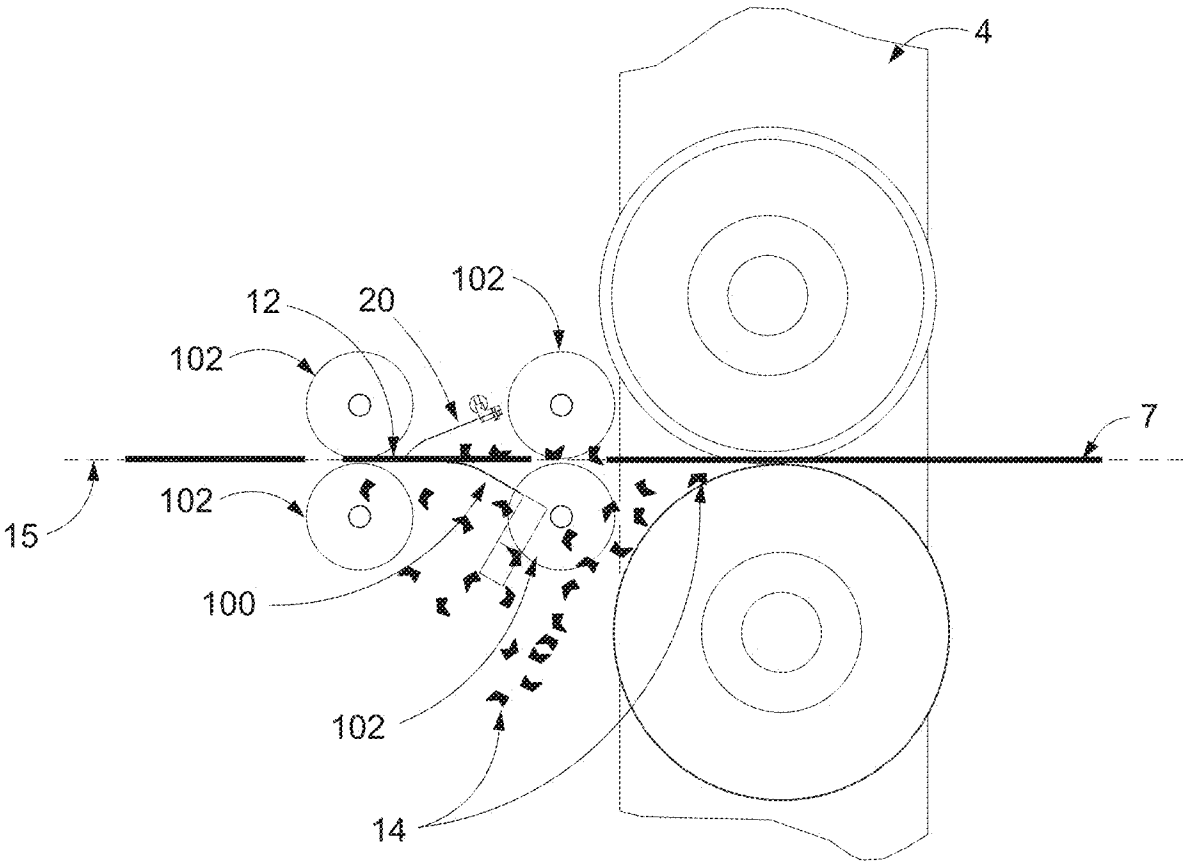
FIG. 32 is a side view of a configuration with a Rigid Nominally Non-Linear Scrap Scraper on the top side of the box and a segmented flexible support on the bottom side of the box.
Figure 33A:
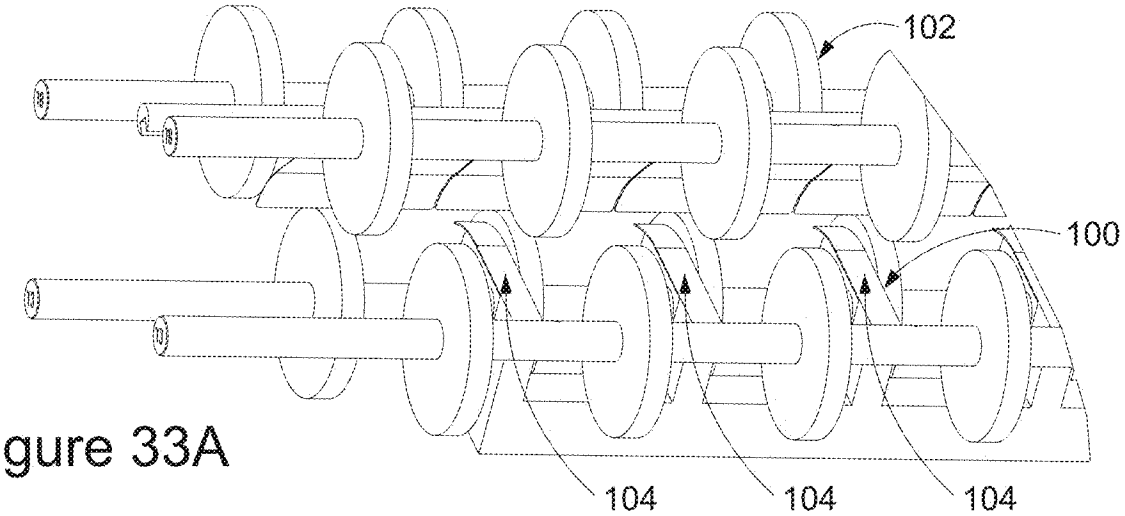
FIG. 33A is a 3D view of FIG. 32.
Figure 33B:
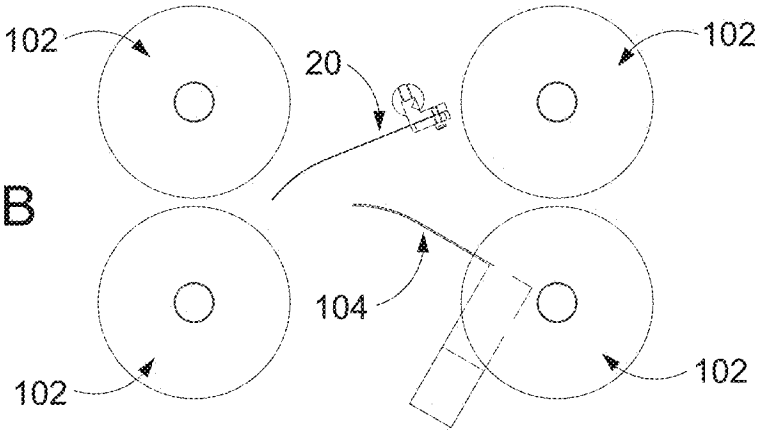
FIG. 33B is a zoomed in side view of FIG. 32.

FIG. 32 is a side view of a configuration with a Rigid Nominally Non-Linear Scrap Scraper 20 on the top side of the box. FIG. 33A is a 3D view of FIG. 32. FIG. 33B is a zoomed in side view of FIG. 32. A segmented flexible support 100 and a wheel assembly 102 (containing a plurality of wheels) are on the bottom side of the box. In one embodiment, the segmented flexible support 100 on the bottom side of the box comprises a plurality of support fingers 104 that serve as support for the moving corrugated boxes (e.g., board guides) while the scrap scraper 20 contacts the moving corrugated boxes 12. The plurality of support fingers 104 have openings between the support fingers. In response to the scraping, the scrap falls into the openings. In one embodiment, the scrap scraper 20 is downstream of the support fingers 104. In some implementations, the scrap scraper 20 extends below the board line 15 and the support fingers 104 are below the board line 15. In one embodiment, the support fingers 104 are flexible and made of metal. However, other materials (flexible and non-flexible) can also be used. The scrap scraper 20 and the support fingers 104 are part of the same layboy.

Figures 34A, 34B, 34C:
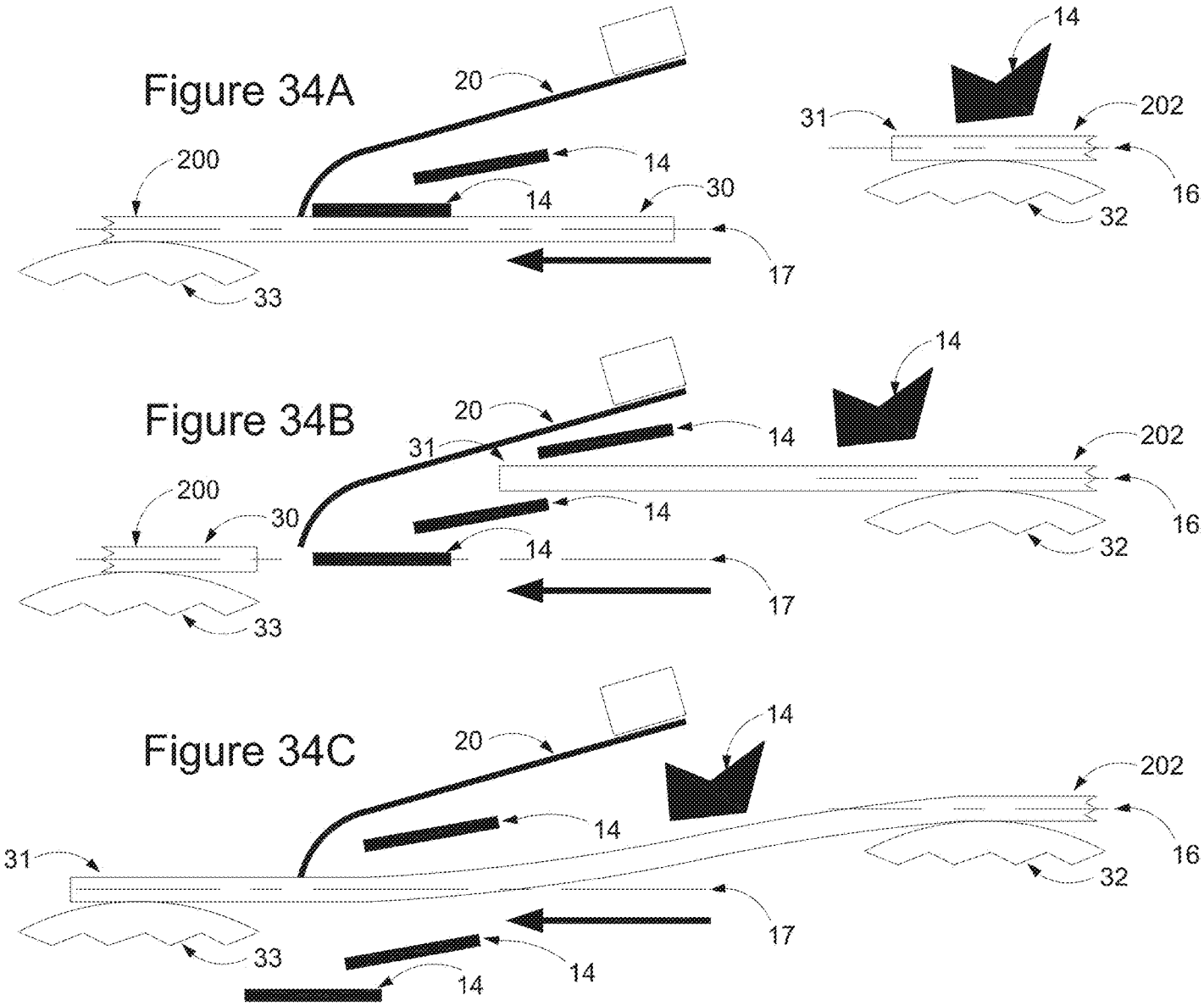
FIG. 34A-34C are side views showing the concept of Scrap Shingling in which offsetting board paths allow getting scrap from the leading box to end up under the subsequent boxes

FIG. 34A-34C are side views of the progressive steps that illustrate a concept referred to as Scrap Shingling, which can be used with any of the embodiments described above. In some cases, neither gravity nor Active Scrap Ejection may be able to get all the scrap out of the way of the subsequent boxes. By configuring the Scrap Scraper so that the scraper entrance board path 16 of the boxes to be elevated above the scraper exit board path 17, the trailing edge 30 of the first box 200 and any scrap 14 that has been accumulator by the Scrap Scraper 20 will likely be below the leading edge 31 of subsequent box 202 (see FIG. 34B) even before gravity or Active Scrap Ejection has had a chance to act on the scrap. Once the subsequent box 202 is engaged with the Scrap Scraper 20 (FIG. 34C), the subsequent box 202 will be deflected to transition from scraper entrance board path 16 to the scraper exit board path 17. The deflecting of subsequent box 202 will push down the scrap. The advantage is that as the last part of the following box is no longer supported by upstream surface 32 the box and the scrap trapped by the scrapers are being moved down for a substantial distance which basically adds to the Sheet Gap Time and the Up Gap Time.

Figure 35:
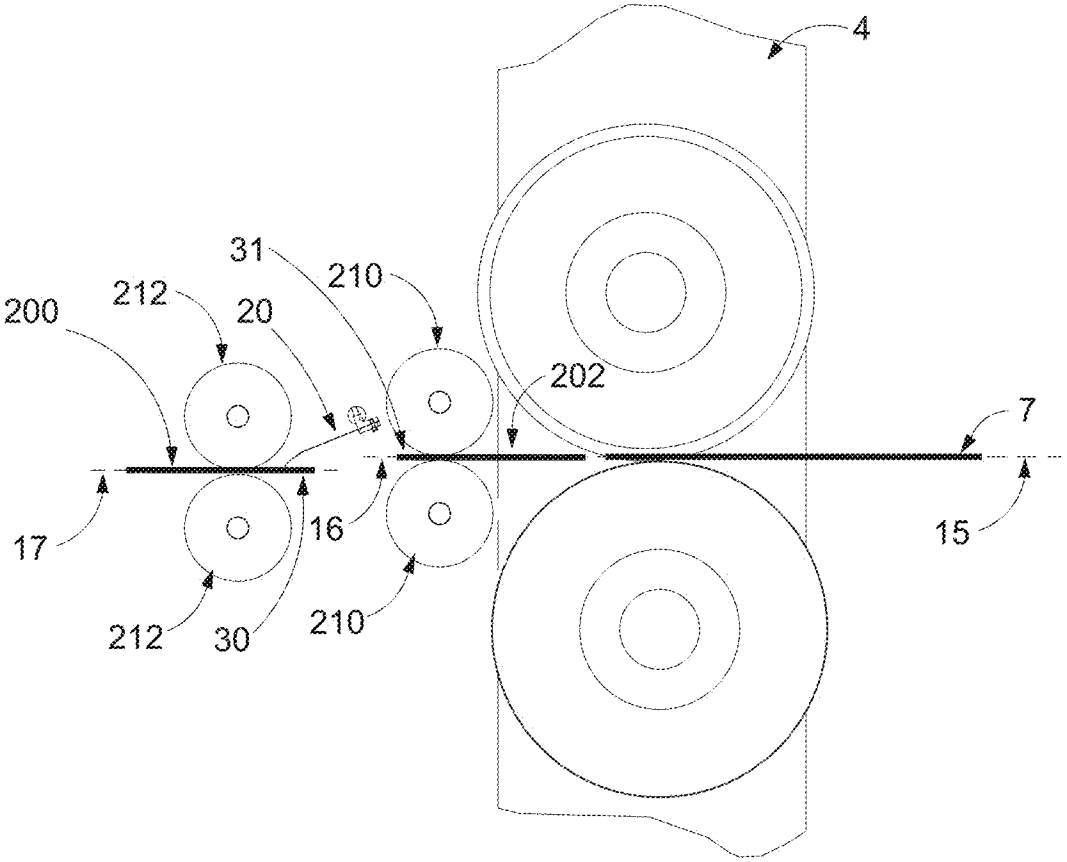
FIG. 35 is a side view of a configuration of wheel assemblies to achieve parallel offsetting board paths required for Scrap Shingling

Scrap Shingling can be achieved in many of the possible transport systems, including but not limited to Conveyors, Wheel Assemblies, Rollers, Fixed Surfaces or Overhead Vacuum. The scraper entrance board path 16 can be the same as the board line 15, and the scraper exit board path 17 can be parallel but offset, as shown in FIG. 35. In one embodiment, the scraper entrance board path 16 is configured based on location and orientation of the upstream box support, which in the example of FIG. 35 comprises wheel assemblies 210. In one embodiment, the scraper exit board path 17 is configured based on location and orientation of the downstream box support, which in the example of FIG. 35 comprises wheel assemblies 212. For example, the upstream box support, (e.g., wheel assemblies 210) supports leading edge 31 of box 202 at a first height and the downstream box support, (e.g., wheel assemblies 212) supports trailing edge 30 of box 200 at a second height, where the second height is below the first height. The leading edge of the subsequent box is deflected down from the first height to the second height, thereby pushing down scrap from a previous box The same offset could be achieved using other transport means similar to those shown in FIG. 27B and FIG. 29.

Figure 36:
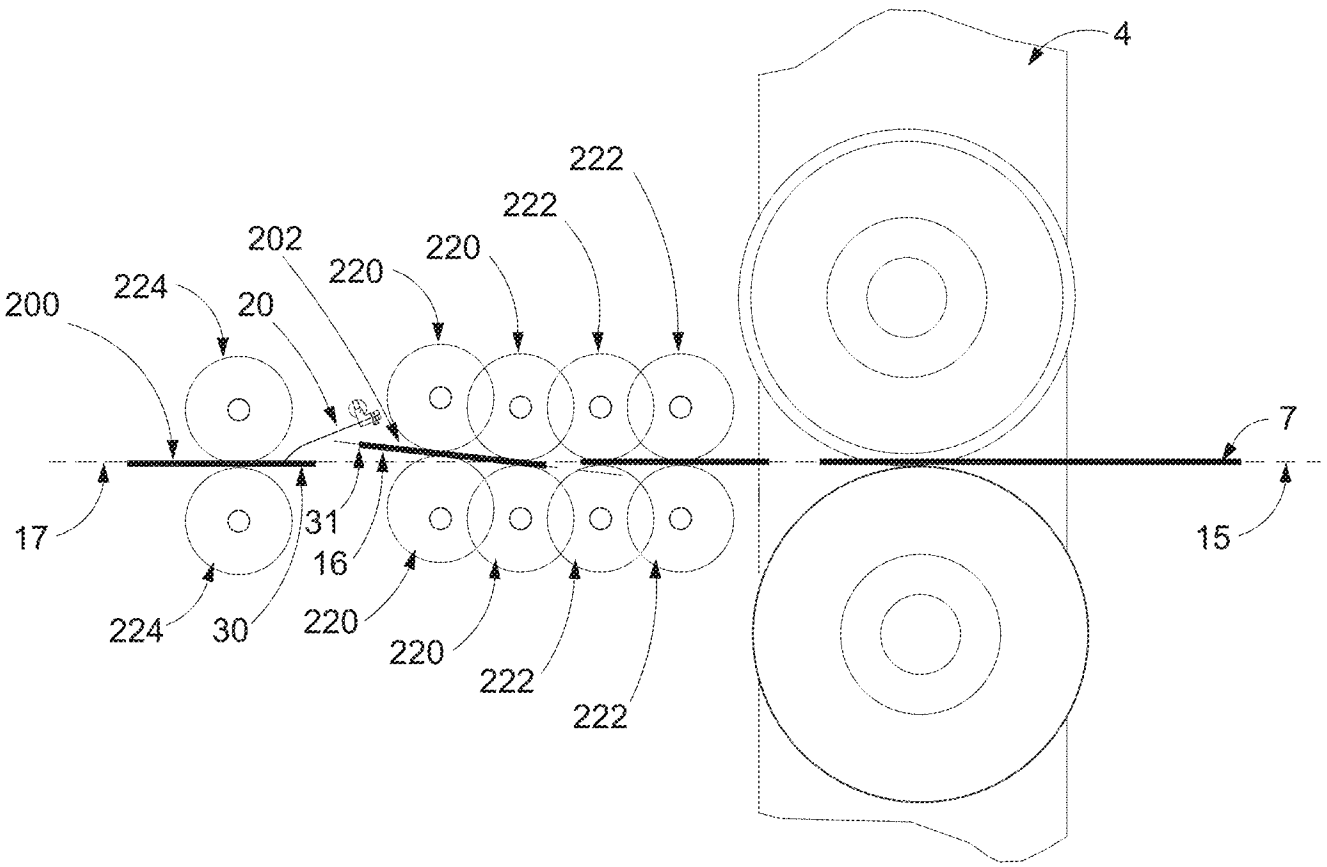
FIG. 36 is a side view of a configuration of wheel assemblies to achieve non-parallel offsetting board paths required for Scrap Shingling

Alternatively, the scraper entrance board path 16 does not have to be parallel or the same as the board line 15. For example, FIG. 36 shows the set of Wheel Assemblies 220 in front of the Scrapers has been offset upwards causing an elevated non-parallel board path but still achieving the goal of having the trail edge 30 of the first box 200 and any scrap 14 that has been accumulated by the Scrap Scraper 20 will likely be below the lead edge 31 of the following box 202. Wheel assemblies 222 are aligned to the board line 15 of the rotary dies cutter 4. Wheel assemblies 224 are positioned and oriented to implement scraper exit board path 17.

The foregoing detailed description has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated.

What is claimed is:

1. An apparatus for separating scrap from moving corrugated boxes, comprising:

one or more surfaces that support and transport the moving corrugated boxes along a path, the one or more surfaces include an opening in the one or more surfaces; and a scrap scraper comprising a contacting edge and an upstream surface that are part of a single element in a through machine direction, the scrap scraper is positioned laterally across and above the path, the scrap scraper is positioned above the opening in the one or more surfaces, the scrap scraper is configured to contact the moving corrugated boxes with the contacting edge of the scrap scraper, the contacting edge of the scrap scraper is configured to perform a scraping action against an upper surface of the boxes to scrape scrap across the upper surface of the boxes;

the scrap scraper comprises a non-linear cross-sectioned panel having a box contact end and a funnel region distal to the box contact end, the contacting edge of the scrap scraper is at the box contact end, the box contact end includes a contact surface that is configured to make contact with the scrap, the contact surface forms a scraper angle of action with the path, a tangent of the panel at the funnel region forms a scraper funnel angle with the moving corrugated boxes, the scraper angle of action is greater than the scraper funnel angle.

2. The apparatus of claim 1, wherein:

the scrap scraper has a vertical position that can be adjusted.

3. The apparatus of claim 1, wherein:

the scrap scraper comprises multiple panels.

4. The apparatus of claim 1, wherein:

the moving corrugated boxes travel along a board line, the panel extends below the board line.

5. The apparatus of claim 1, wherein:

the scrap scraper in integrated in a layboy.

6. The apparatus of claim 1, wherein:

the panel is a metal panel.

7. The apparatus of claim 1, wherein:

a board path leading into the scrap scraper is elevated relative to a board path exiting the scrap scraper.

8. The apparatus of claim 1, wherein:

the contacting edge of the scrap scraper is elongated in the cross machine direction.

9. An apparatus for separating scrap from moving corrugated boxes, comprising:

one or more surfaces that support and transport the moving corrugated boxes along a path; and a scrap scraper positioned above the path, the scrap scraper comprises a non-linear cross-sectioned panel having a box contact end and a funnel region distal to the box contact end, the box contact end includes a contact surface that is configured to make contact with the scrap, the box contact end is configured to contact the moving corrugated boxes and perform a scraping action against an upper surface of the moving corrugated boxes to scrape scrap across the upper surface of the moving corrugated boxes, the contact surface forms a scraper angle of action with the path, a tangent of the panel at the funnel region forms a scraper funnel angle with the path, the scraper angle of action is greater than the scraper funnel angle, the panel is configured to provide a flexing force on the moving corrugated boxes.

10. The apparatus of claim 9, wherein:

the panel comprises a single element in a through machine direction.

11. The apparatus of claim 9, wherein:

the panel is elongated in across machine direction.

12. The apparatus of claim 9, wherein:

the scraper angle of action is an angle between the path and a tangent of the contact surface.

13. An apparatus for separating scrap from moving corrugated boxes, comprising:

one or more surfaces that transport the moving corrugated boxes along a path, the one or more surfaces include an opening in the one or more surfaces; and a scrap scraper positioned laterally across and above the path, the scrap scraper is positioned above the opening in the one or more surfaces, the scrap scraper comprises a non-linear cross-sectioned panel having a box contact end and a funnel region distal to the box contact end, the box contact end includes a contact surface that is configured to make contact with the scrap, the box contact end is configured to perform a scraping action against an upper surface of the moving corrugated boxes to scrape scrap across the upper surface of the moving corrugated boxes, the contact surface forms a scraper angle of action with the path, a tangent of the panel at the funnel region forms a scraper funnel angle with the moving corrugated boxes, the scraper angle of action is greater than the scraper funnel angle.

14. The apparatus of claim 13, wherein:

the scraper angle of action is an angle between the path and a tangent of the contact surface, the scrap scraper extends below the path.

15. The apparatus of claim 13, wherein:

the panel comprises a single element in a through machine direction.

16. The apparatus of claim 13, wherein:

the panel is elongated in across machine direction.

17. An apparatus for separating scrap from corrugated boxes, comprising:

one or more support surfaces that support and transport the corrugated boxes, the one or more support surfaces include an entrance board path for transporting the corrugated boxes and an exit board path for transporting the corrugated boxes, the one or more support surfaces include an opening between the entrance board path and the exit board path; and a scrap scraper positioned above the opening between the entrance board path and the exit board path, the scrap scraper comprises a contacting edge and an upstream surface, the upstream surface is upstream as compared to the contacting edge in relation to direction from the entrance board path to the exit board path, the contacting edge is configured to perform a scraping action against an upper surface of the corrugated boxes to scrape scrap across the upper surface of the corrugated boxes, the upstream surface of the scrap scraper is configured to divert forward motion of the scrap, the entrance board path leads into the scrap scraper and is elevated relative to the exit board path which exits the scrap scraper such that once a corrugated box is engaged with the scrap scraper the corrugated box will be deflected to transition from the entrance board path leading into the scrap scraper to the exit board path exiting the scrap scraper, the contacting edge of the scrap scraper and the upstream surface are part of a single element in a through machine direction.

18. The apparatus of claim 17, wherein:

the scrap scraper comprises a non-linear cross-sectioned panel having a box contact end and a funnel region distal to the box contact end, the contacting edge of the scrap scraper is at the box contact end, the box contact end includes a contact surface that is configured to make contact with the scrap, the contact surface forms a scraper angle of action with the path, a tangent of the panel at the funnel region forms a scraper funnel angle with the moving corrugated boxes, the scraper angle of action is greater than the scraper funnel angle.

19. The apparatus of claim 17, wherein:

the exit board path comprises a downstream wheel assembly that supports a trailing edge of a particular box at a first height; and the entrance board path comprises an upstream wheel assembly that supports a leading edge of a subsequent box at a second height, the first height is below the second height.

20. The apparatus of claim 17, wherein:

the entrance board path is parallel to the exit board path.

21. The apparatus of claim 17, wherein:

the contacting edge of the scrap scraper is elongated in across machine direction.

* * * * *